US006240272B1

(12) United States Patent
Honda

(10) Patent No.: US 6,240,272 B1
(45) Date of Patent: May 29, 2001

(54) IMAGE FORMING APPARATUS FOR CONTROLLING APPLIED VOLTAGE TO SEPARATION CHARGER

(75) Inventor: Takao Honda, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/458,687

(22) Filed: Dec. 10, 1999

(30) Foreign Application Priority Data

Dec. 18, 1998 (JP) ..... 10-361458

(51) Int. Cl.[7] ..... G03G 15/16
(52) U.S. Cl. ..... 399/315
(58) Field of Search ..... 399/66, 315, 398, 399/127, 128, 129

(56) References Cited

U.S. PATENT DOCUMENTS 4,896,192 * 1/1990 Kinoshita ..... 399/66
5,012,293 * 4/1991 Aldrich et al. ..... 399/66
5,408,300 * 4/1995 Wataki et al. ..... 399/313
5,587,780 * 12/1996 Sugino et al. ..... 399/315
5,655,176 * 8/1997 Inoue et al. ..... 399/45
5,943,530 * 8/1999 Ozasa ..... 399/129

FOREIGN PATENT DOCUMENTS 54-086343 * 7/1979 (JP) .
63-137282 * 6/1988 (JP) .
3-009385 * 1/1991 (JP) .
4-159566 * 6/1992 (JP) .
8-030108 * 2/1996 (JP) .

* cited by examiner

*Primary Examiner*—Robert Beatty
(74) *Attorney, Agent, or Firm*—Fitzpatrick, Cella, Harper & Scinto

(57) ABSTRACT

An image forming apparatus has a voltage applying device that applies a lower voltage than a voltage in separating when no transfer material exists between an image bearing member and a seperation charger.

6 Claims, 19 Drawing Sheets

IMAGE FORMING APPARATUS FOR CONTROLLING APPLIED VOLTAGE TO SEPARATION CHARGER

BACKGROUND OF THE INVENTION

1. Field of the Invention

The present invention relates to an image forming apparatus such as copying machine or printer using an electrophotographic process or electrostatic recording process.

2. Related Background Art

In recent years, transmission of digital data information by a data communication network and an image forming apparatus as a hard output device for the information have vigorously been proposed. As this kind of image forming apparatus, a digital printer and a digital copying machine exist.

FIG. 19 shows a schematic construction of the digital printer. A photosensitive member (photosensitive drum) 1 is constructed by forming a photoconductive layer on a cylindrical conductive base member and is pivotably supported in the direction shown by an arrow R1 in the diagram. Around the photosensitive drum 1, substantially in accordance with the order along the rotating direction, a scorotron charger (primary charger) 2 for uniformly charging the surface of the photosensitive drum 1, an exposing device 3 for reading original and exposing the photosensitive drum 1 on the basis of an image signal that is proportional to the density of an image to form an electrostatic latent image, a developing device 7 for developing the electrostatic latent image as a toner image by adhering toner to it, a corona transfer charger (transfer charger) 8 for transferring the toner image formed on the photosensitive drum 1 to a transfer sheet P as a transfer material, an electrostatic separate charger (separate charger) 9 for separating the transfer sheet P on which the toner image has been transferred from the photosensitive drum 1, a cleaning device 3 for removing the residual toner on the photosensitive drum 1 after the toner image is transferred, and a pre-exposing lamp 30 for eliminating a residual charge on the photosensitive drum 1 are arranged. The transfer sheet P on which the toner image has been transferred is conveyed to a fixing device 12 after it is separated from the photosensitive drum 1. The toner image is fixed to form a desired print image. The transfer sheet P is discharged out of the image forming apparatus main body.

In a reader unit 18, light is irradiated to original 15 stacked on an original glass stage 14 by an illuminating lamp 16 and reflected light is formed as an image on a photoelectric converting element (one-line CCD) 19, thereby converting the image into an electric signal corresponding to image information. The reflected light from the original 15 irradiated by the illuminating lamp 16 is introduced by mirrors 17*a*, 17*b*, and 17*c* and is formed as an image on the photoelectric converting element 19 by a lens 17*d*. The electric signal generated by the photoelectric converting element 19 is A/D converted by an A/D converter 21 to set digital image data of eight bits (8-bit). After that, in order to convert luminance information into density information by a black signal generating circuit 22, the data is logarithmically converted and is set to image density data by a binarization circuit 23.

The 8-bit digital image data signal formed as mentioned above is inputted to a laser driving circuit 24. The laser driving circuit 24 is a well-known PWM circuit and modulates a light emitting time to turn on/off a semiconductor laser 20 in accordance with the level of the inputted image density signal.

For example, as shown in FIGS. 4A to 4C, when the image data every pixel is inputted in the scanning direction of the laser as shown in FIG. 4A, a driving signal to turn on/off the laser is as shown in FIG. 4B. That is, when the image data is set to 00 hex (hexadecimal), the ON duty of the laser driving signal is set to 5% of one pixel scanning time and, when it is set to FFhex, the ON duty of the laser driving signal is set to 85% of one pixel scanning time. In this manner, dark and light states are realized by making an area gradation in one pixel.

Further, FIG. 6 shows ordinary I–L characteristics (driving current—light amount characteristics) of the laser. The driving currents which are used at the ON/OFF times of the laser are shown by Ion and Ioff, respectively. Therefore, the laser driving current for the image signal in FIG. 4 is as shown in FIG. 4C. It is a current whereby the PWM circuit drives the laser.

The laser driving system is mainly divided to the above-mentioned PWM circuit and a binary laser driving circuit. As mentioned above, the PWM circuit modulates the signal to a pulse width signal corresponding to the time for light emission by the semiconductor laser in accordance with the level of the inputted image density signal. On the other hand, the binarization circuit converts the signal into a two-stage signal of a specific ON light emission signal and an OFF signal corresponding to a pixel size and inputs the converted signal to the laser driving circuit 24, thereby turning on/off the laser (semiconductor laser device) 20. As a representative binarizing method, there is a method of generating a binarized signal on the basis of image data by using a method such as error diffusion method or dither method. Fundamentally, the time to generate laser light is held constant irrespective of the density. It differs with respect to a point that the laser light is emitted to a pixel having a low density at a low probability and, as the density of a pixel is higher, the laser light is emitted at a higher probability.

The laser light driven and emitted in accordance with the image signal as mentioned above is written to the photosensitive drum 1 in a raster scanning manner through a polygon mirror scanner 28 that is rotated at a high speed and a mirror 17*f* to form a digital electrostatic latent image as image information.

The electrostatic latent image on the photosensitive drum 1 is developed to be visualized by the developing device 7 by using the toner.

The toner image on the photosensitive drum 1 is electrostatically transferred to the transfer material P by the transfer charger 8.

The separate charger 9 applies a high AC or DC superposed voltage having a polarity opposite to that in the transfer to a conductive wire that is stretched in a metallic shield case having a low potential, biased bipolar ions are supplied to the rear surface of the transfer material which faces the drum to substantially neutralize and reduce a transfer electric field, and the electrostatic adsorption charge is eliminated from the transfer material electrostatically absorbed to the surface of the drum. Consequently, the transfer material is separated from the curving surface of the drum due to the self-weight and the rigidity of the transfer material. As described in the transfer as well, the transfer current is increased in order to assure the transfer efficiency by the toner having low transfer efficiency. It is disadvantageous for separation performance and it is difficult to assure the absolute amount of the charge eliminating current and balance the two polarities.

Particularly with respect to the separation of the transfer material, as the operating speed of the image forming apparatus is faster, the charge eliminating current is lacked, so that the separation becomes unstable.

In order to cope with the above, means for increasing the applied voltage is used as a method of remarkably increasing the total current amount for the separation. However, when the voltage is more than enough, a current leakage easily occurs between the photosensitive drum and the separation charge shield portion. Particularly, in the case where the apparatus has been used for a long time, paper particles of the transfer material and scattered toner are deposited on the shield of the separate charger and stain the shield. Consequently, unevenness as discharge impedance occurs in a low potential shield portion as a discharge counter electrode, the charges concentratedly flow into a low impedance portion, and the leak occurs extremely often. Further in a high humidity environment, a material which stains the shield absorbs moisture. The leak easily occurs due to the moisture absorption by, especially, the long fiber-shaped paper particles.

Particularly, the leak easily occurs in a non-image area when it is necessary to operate the separate charger in the non-image area where no transfer material exists for a period of time during which the image is not formed. When no transfer material exists and the current cannot flow into the transfer material, the leak easily occurs.

When the leak current is large, as a derived failure, such a failure that a pit is formed on the photosensitive drum due to a voltage attack at the leak time to generate a black dot or the discharging wire of the separate charger is disconnected occurs.

SUMMARY OF THE INVENTION

It is an object of the present invention to provide an image forming apparatus whose performance to separate a transfer material is high.

Another object of the present invention is to provide an image forming apparatus in which a current is not leaked from a separate charger to an image bearing member.

Still another object of the present invention is to provide an image forming apparatus comprising:

an image bearing member for bearing a toner image;

transfer means for transferring the toner image on the image bearing member to a transfer material;

a separate charger for allowing the transfer material to be easily separated from the image bearing member; and voltage applying means for control a voltage to be applied to the separate charger, wherein the voltage applying means applies a lower voltage than a voltage in separating when no transfer material exists between the image bearing member and the separate charger.

Still other objects of the present invention will become apparent from the following description.

DETAILED DESCRIPTION OF THE PREFERRED EMBODIMENTS

Embodiments of the present invention will now be described hereinbelow with reference to the drawings.

Embodiment 1

Figure 1:
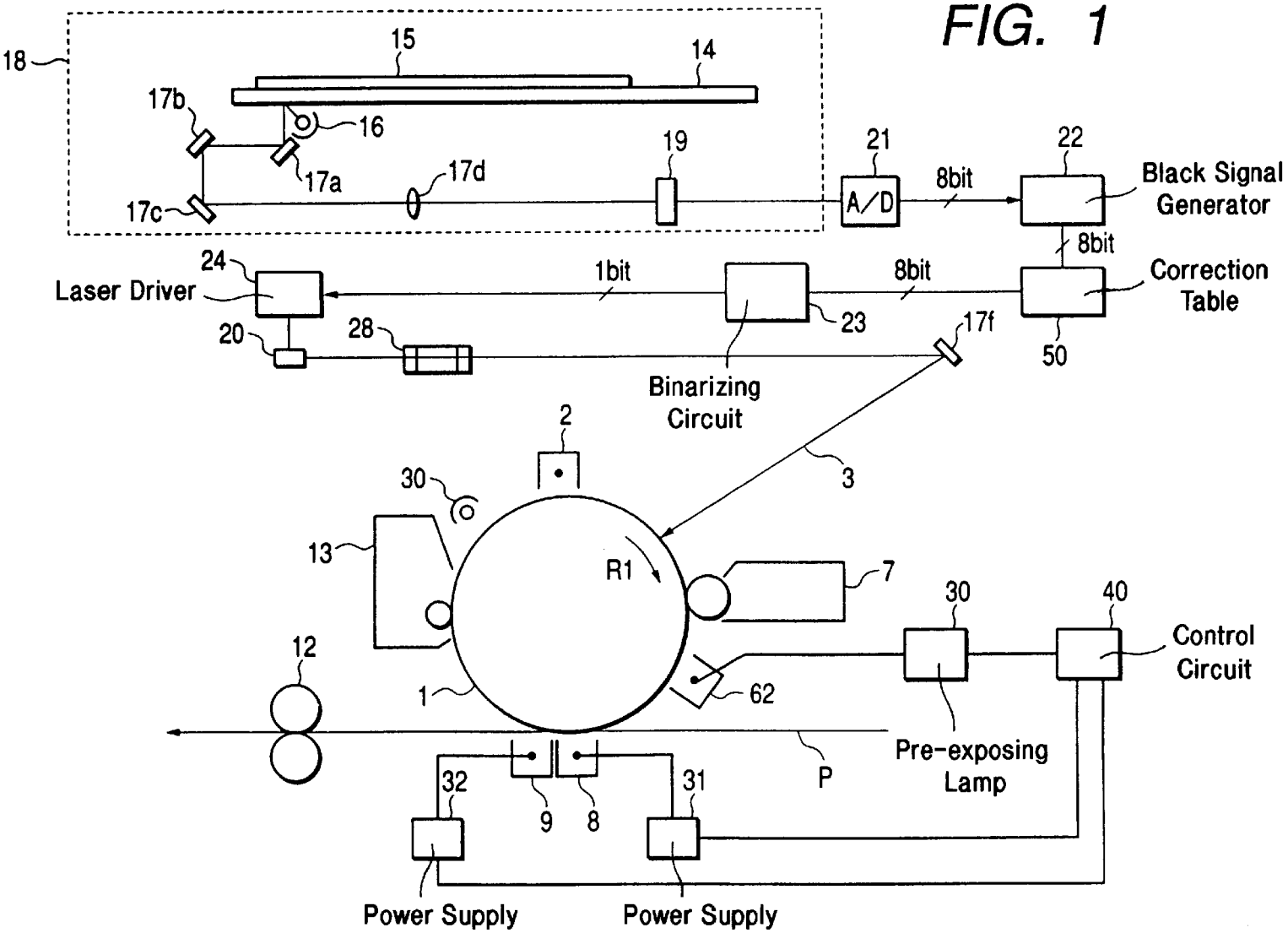
FIG. 1 is a longitudinal sectional view showing the schematic construction of an image forming apparatus of an embodiment 1.

FIG. 1 shows an example of an image forming apparatus according to the present invention. The image forming apparatus shown in FIG. 1 is a laser beam printer (hereinbelow, referred to as an "image forming apparatus"). FIG. 1 is a longitudinal sectional view showing the schematic construction thereof.

The image forming apparatus shown in the diagram has the drum-shaped electrophotographic photosensitive member (hereinbelow, referred to as a "photosensitive drum") as an image bearing member. The photosensitive drum 1 is constructed by forming a photoconductive layer (photoconductive member for forming an electrostatic latent image) on a cylindrical conductive base member and is pivotably supported in the direction shown by the arrow R1 in the diagram. Around the photosensitive drum 1, in accordance with the order along the rotating direction, the scorotron charger (primary charger) 2 for uniformly charging the surface of the photosensitive drum 1, exposing device (micro point exposing means) 3 for reading original and exposing the photosensitive drum 1 on the basis of an image signal that is proportional to the density of an image to form an electrostatic latent image, developing device 7 for developing the electrostatic latent image as a toner image by adhering toner to the latent image, and a developer charge amount control charger (hereinbelow, referred to as a "post-charger") 62 for adjusting the toner charge amount of the toner image on the photosensitive drum 1 after the development so as to raise the transfer efficiency are arranged. A conveying system for conveying the transfer sheet (transfer material) P to a transfer portion is arranged. The corona transfer charger (transfer charger) 8 as a transfer device for transferring the toner image formed on the photosensitive drum 1 onto the transfer sheet P, electrostatic separate charger (separate charger) 9 for separating the transfer sheet P on which the toner image has been transferred from the photosensitive drum 1, cleaning device 13 for removing the residual toner remained on the photosensitive drum 1 after the toner image is transferred, and pre-exposing lamp 30 for eliminating the residual charge on the photosensitive drum 1 are arranged. The transfer sheet P on which the toner image has been transferred is separated from the photosensitive drum 1 and, after that, conveyed to the fixing device 12. The toner image on the surface is fixed in the device to form a desired print image. The transfer sheet is discharged out of an image forming apparatus main body 101.

In the reader unit 18, light is irradiated to the original 15 stacked on the original glass stage 14 by the illuminating lamp 16 and reflected light is formed as an image on the photoelectric converting element (one-line CCD) 19, thereby converting the image into an electric signal corresponding to image information. The reflected light from the original 15 irradiated by the illuminating lamp 16 is introduced by the mirrors 17*a*, 17*b*, and 17*c* and is formed as an image on the photoelectric converting element 19 by the lens 17*d*. The electric signal generated by the photoelectric converting element 19 is A/D converted by the A/D converter 21 to set digital image data of eight bits. After that, in order to convert luminance information into density information by the black signal generating circuit 22, the data is logarithmically converted and the resultant data is set to image density data.

The image density data (8-bit digital image data signal) formed as mentioned above is converted into a two-stage signal of an ON light emission signal of a specific On time and an OFF signal corresponding to a pixel size through the binarizing circuit 23. The signal is inputted to the laser driving circuit 24. After a dot reproducibility correction is added to the driving current, the semiconductor laser is turned on/off at a timing of the binarized driving signal by the error diffusion method in accordance with the level of the inputted image density signal.

In the present embodiment, although the binarization circuit 23 is realized by the error diffusion method, it can also be realized by the dither method or the other method. The laser driving circuit 24 can be set to the well-known PWM circuit and the system for modulating the ON/OFF light emission time of the semiconductor laser in accordance with the level of the inputted image density signal after the dot reproducibility correction is added to the driving current can be used.

Figure 5A:
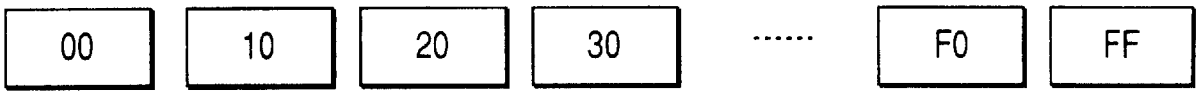
FIGS. 5A and 5B are diagrams explaining laser lighting of binary image data.
Figure 5B:
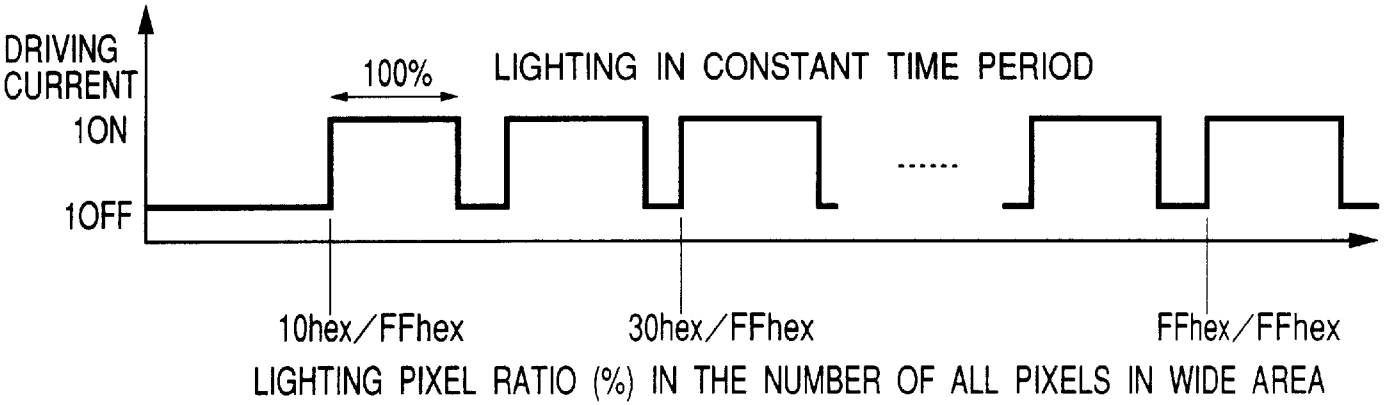

For example, the laser lighting of the binary image data will now be schematically described as shown in FIGS. 5A and 5B. When image data every pixel is inputted in the scanning direction of the laser as shown in FIG. 5A, the driving current to turn on/off the laser is as shown in FIG. 5B. Although the lighting is performed for a constant time period by a constant driving current irrespective of image data, a lighting pixel ratio in the number of all pixels in a plurality of specific pixel areas changes in correspondence to the image data and an exposure density in the plurality of pixel areas is modulated. That is, the number of ON times of the laser driving signal when the image data is set to 00 hex is set to 0% of the lighting pixel ratio in the number of all pixels in the plurality of specific pixel areas, and the number of ON times of the laser driving signal when the image data is FFhex is set to 100% of the lighting pixel ratio in the number of all pixels in the specific plurality of pixel areas. Even in case of 0% of the lighting pixel ratio, a constant driving current flows as a bias current and light is slightly emitted. In this manner, the dark and light states are realized by performing the area gradation in the plurality of specific pixel areas.

Figures 4A, 4B, 4C:
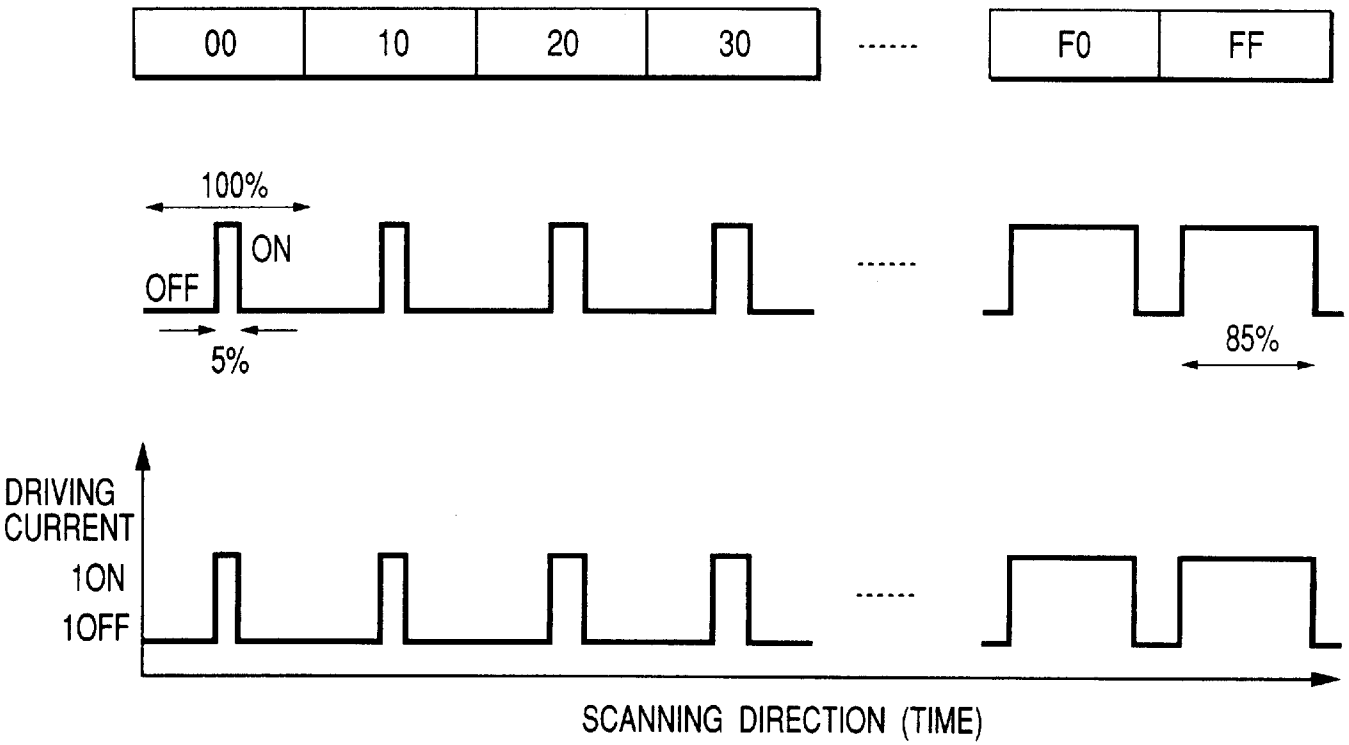
FIGS. 4A, 4B and 4C are diagrams showing a relation between image data every pixel, a driving signal of a laser, and a driving current.

As shown in FIGS. 4A to 4C, it is a matter of course that it is set to the PWM system. When the image data every pixel is inputted in the scanning direction of the laser as shown in FIG. 4A, the driving signal to turn on/off the laser is as shown in FIG. 4B. That is, when the image data is set to 00 hex, the ON duty of the laser driving signal is set to 5% of the scanning time per pixel and, when it is set to FFhex, the ON duty of the laser driving signal is set to 85% of the scanning time per pixel. In this manner, the dark and light states are realized by performing the area gradation in one pixel.

Figure 6:
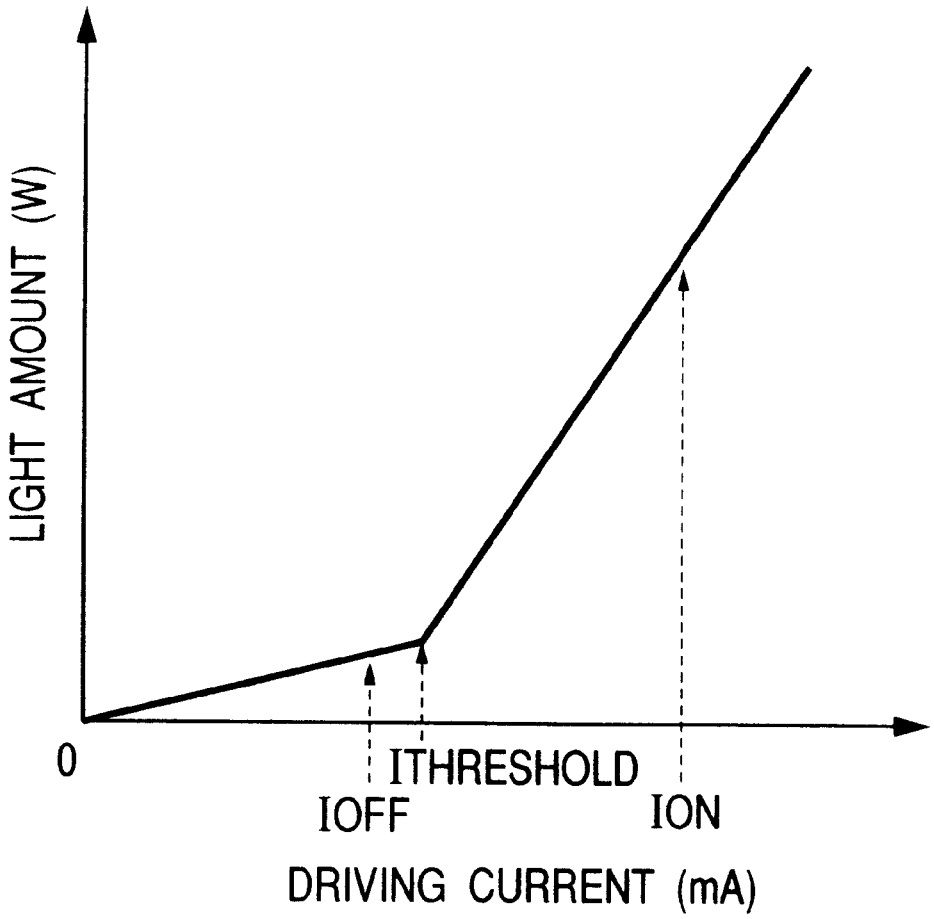
FIG. 6 is a graph showing general I–L characteristics (driving current—light amount characteristics) of the laser.

Further, FIG. 6 shows general I–L characteristics (driving current—light amount characteristics) of the laser. Since the driving currents which are used when the laser is turned on and off are shown by Ion and Ioff, respectively, the laser driving currents for the image signals in FIGS. 5 and 4 are as shown in FIGS. 5B and 4C. Those denote the current for driving the laser 20 through the binarization circuit 23, PWM circuit (not shown), and laser driving circuit 24. It is known that Ioff is not set to 0 mA but it is set to a value that is slightly smaller than Ithreshold, thereby improving the rise of the light amount when the laser is turned on.

In this case, a laser beam having visible light of 680 nm is used as a laser.

The laser light driven and emitted in response to the image signal is written to the photosensitive drum 1 in a raster scanning manner through the polygon mirror scanner 28 which rotates at a high speed and the mirror 17*f*, thereby forming a digital electrostatic latent image as image information.

In the present embodiment, an amorphous silicon drum is used as a photosensitive drum 1. The amorphous silicon drum has such characteristics that the stability of the features of a conductive base member is high, the durability is high, and the duration of life is long. For the a-Si (amorphous-silicon) photosensitive member which has a long duration of life and is acceptable to a high-speed output and in which the surface layer is a Sic (silicon carbide) curing type and which is optically high-sensitive to a photosensitive layer, since the charge retaining performance is high and scattering or the like of irradiation light due to the surface layer hardly exists, a micro electrostatic latent image in a micro spot exposing portion by the laser irradiation is retained without scattering the charges, so that the micro latent image of 600 dpi or 1200 dpi is formed at a high fidelity and a remarkably fine latent image is formed.

Figure 2A:
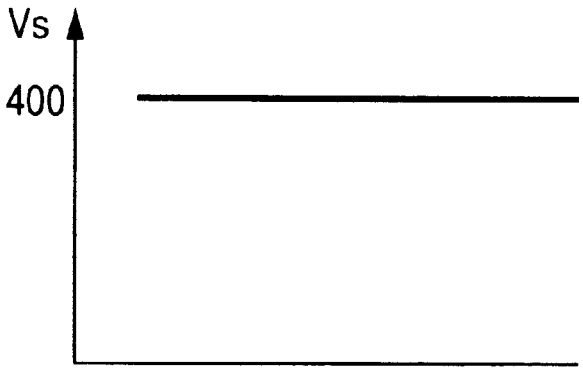
FIGS. 2A, 2B and 2C are graphs schematically showing a relation between the surface potential of a photosensitive drum and a bias voltage in development.
Figure 2B:
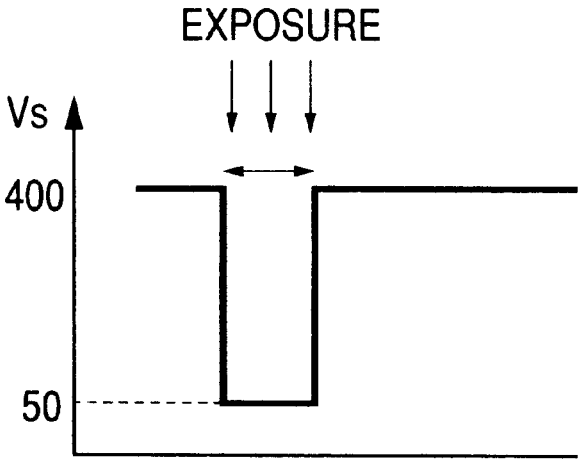
Figure 2C:
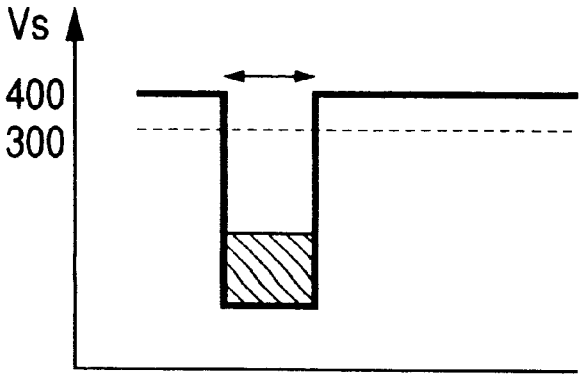

FIGS. 2A to 2C show steps for explaining the image forming process of the present embodiment. A relation between the surface potential of the photosensitive member and a developing bias voltage is schematically shown in the diagrams.

Referring to FIG. 2A, the photosensitive member is uniformly charged to +420V by the corona charger.

Referring to FIG. 2B, the image information is exposed. The surface potential in the exposing portion of the image information is attenuated to +50V, thereby forming an electrostatic latent image. Since the image exposure has a light amount whose pulse width is modulated as mentioned above, as for the actual potential of the photosensitive drum after the exposure, the potential of the laser OFF portion and the potential of the laser ON portion merely exist in principle. However, a general non-contact surface electrometer for measuring an integrated potential in an enough wide area measures the spot diameter of the laser as a potential of halftone. That is, since the exposure is slightly performed even in the non-image portion (image data: 00 hex) of the image area as mentioned above, the surface potential is attenuated to +400V and, in an image portion (image data: FFhex) of the image area, the surface potential is attenuated to +50V to form the electrostatic latent image.

Next, referring to FIG. 2C, a developing bias voltage (for example, it is obtained by superposing a direct current DC to an alternating current AC by +280V. A broken line shows the direct current DC component.) is applied to a sleeve of the developing device to perform reversal developing of the exposing portion. In this instance, the developing device develops so as not to come into contact with the photosensitive member by using a well-known mono-component magnetic toner.

Subsequent to the above processing steps, the following steps will be described with reference to FIG. 1. First, component units will now be explained.

The transfer pre-charger (post-charger) 62 has a high-voltage power supply 30 in which an alternating current power supply and a direct current power supply are connected in series. The AC power supply has a power output having a rectangular waveform in which Vpp is equal to 9 kV and the frequency is set to 700 Hz. The DC power supply is constructed by a constant current source in which the bias amount of the AC component, namely, the bias amount (hereinbelow, referred to as a "differential current") of the vibration center of the AC can be varied in a range from 0 to +300 $\mu$A. A control circuit (CPU) 40 as control means properly adjusts the power output of the power supply 30.

The transfer charger 8 has a high-voltage power supply (power supply) 31 constructed by a constant current source in which the DC current can be varied in a range from 0 to −650 $\mu$A. Similarly, the control circuit 40 properly adjusts the power output of the power supply 31. A high-voltage power supply (power supply) 32 of the separate charger 9 is constructed by connecting an AC power supply and a DC power supply in series. The AC power supply has a power output having a sine waveform in which Vpp is equal to 11.5 kV and the frequency is set to 700 Hz. The DC power supply is a constant current source in which the differential current can be varied in a range from 0 to +500 $\mu$A. Similarly, the control circuit 40 controls the power output of the power supply 32.

The reversal developing is performed in the development to form a toner image. Although it is ideal that the toner is charged to positive (plus), the toner charged to negative (minus) actually exists. The toner charged to negative is developed to a portion having a potential of +400V. The transfer pre-charger 62 substantially uniforms the charge amount of the toner. A minus charge is supplied to the rear surface of the transfer sheet P by the transfer charger 8 to set the potential of the rear surface of the transfer sheet P to −450V, thereby transferring the toner image to the transfer sheet P. The unnecessary minus charge supplied to the rear surface of the transfer sheet P is eliminated by the separate charger 9 to set the potential of the transfer sheet P to about 0V, the adsorptive force of the transfer sheet P to the photosensitive drum 1 is weakened, the transfer sheet P is favorably separated from the photosensitive drum 1, and a desired image can be obtained on the transfer sheet P.

After that, the transfer sheet P is electrostatically separated from the photosensitive drum 1 by the separate charger 9, the separated transfer sheet P is sent to the fixing device 12 to fix the image, and the fixed image is finally obtained. The differential current of a separation current to be supplied to the separate charger 9 is biased to a polarity to eliminate the charge on the rear surface of the transfer sheet P, that is contributed to hold the transfer sheet P onto the photosensitive drum 1 in the transfer process, namely, the positive polarity in the present embodiment and is used.

The separation current control will now be described. The differential current condition of the transfer pre-charger 62 is +100 $\mu$A and the differential current condition of the separate charger 9 is +250 $\mu$A.

When the separation differential current is too small or too large, it shows a tendency to deteriorate. When it is too small, the transfer sheet P cannot be completely separated from the photosensitive drum 1 to generate a separation failure. On the contrary, when it is too large, such a phenomenon that the toner is counter-transferred to the photosensitive drum 1 occurs. The separation differential current is set to an optimum value.

A separation leak preventing sequence in the non-sheet passing operation area as characteristics of the present invention will now be shown hereinbelow. The operation of the present invention will now be sequentially described with reference to FIG. 21.

The outline is that a separation charge voltage deteriorates to a leak safety voltage in a state where the sheet does not pass on the charger.

Figure 21:
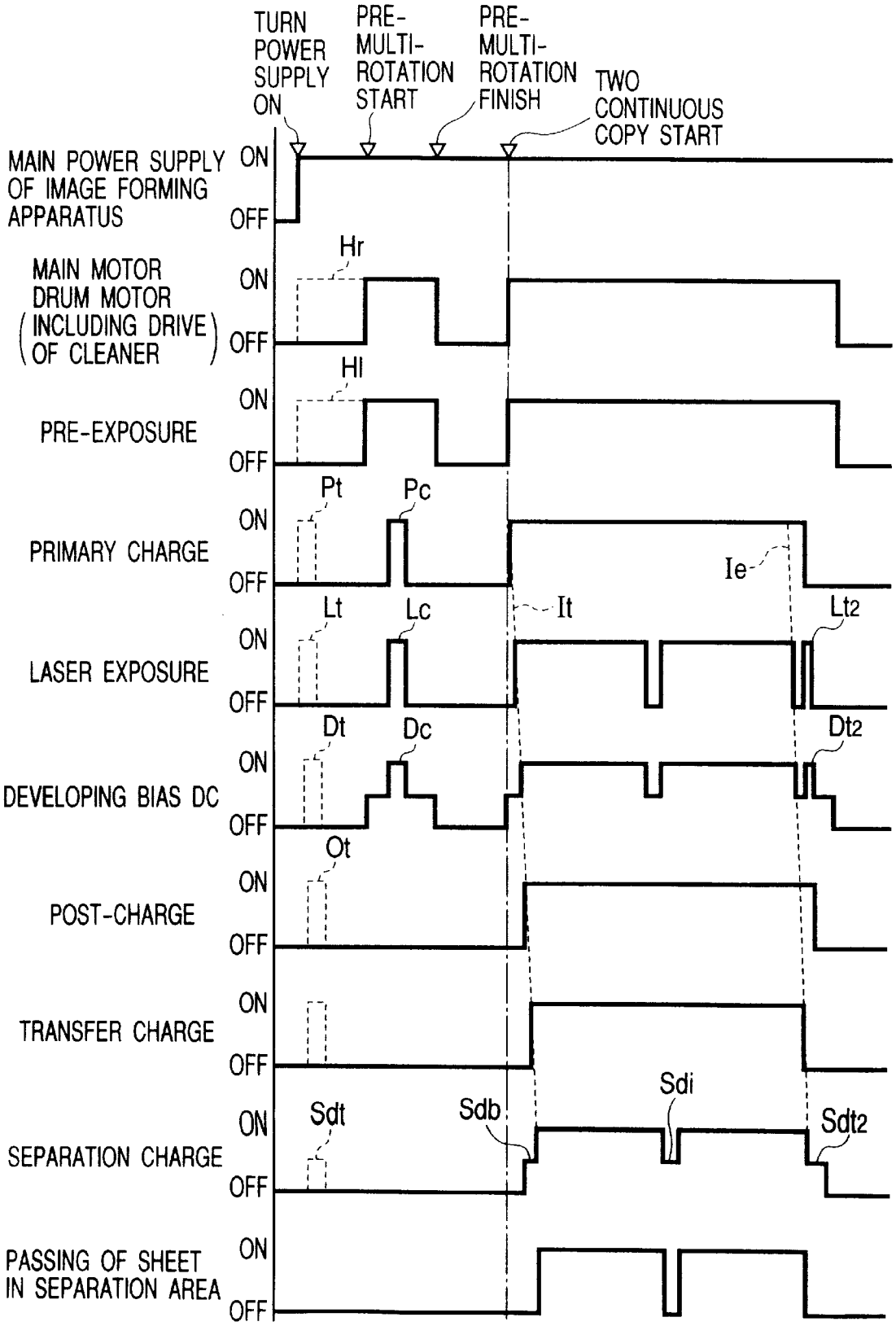
FIG. 21 is a diagram showing the operation sequences of the devices in the present invention.

FIG. 21 will now be described hereinbelow in accordance with the operating order. When a main power supply switch is turned on and it is detected that a fixing thermistor temperature is equal to 100° C. or less and water content W≧9 g in a specific water content area in the environment, it is discriminated that it is a state of the first run in the morning in a high humidity environment. A drum motor and a main driving motor (main motor) which are shown by Hr are operated to allow the drum to run idle. Simultaneously, pre-exposure lighting Hl is performed and, further, a cleaner system driving system (not shown) (it is driven by the same driving as that of the main motor) is operated to perform the rotation of the sleeve of the developing device.

In this instance, a drum deposit scraping sequence to supply developer to the drum is performed.

The sequence performs primary charge Pt to a position on the drum corresponding to the pre-exposing position. As a charge amount, a control value of the previous day, namely, the last potential control value when the preceding power supply is in a current supply state is used to generate the power output. When there is no preceding data, the power output is performed by using a program default value. The output time is equivalent to a period of time corresponding to a black band width or more. There is an excessive charge area (surplus of about 10 mm) before and behind the black band. For a period of time corresponding to the normal black band width, in total, for a period of time corresponding to 100 mm or more in the circumferential direction on the drum, the charge is performed.

Charging is performed to a portion where the length in the main scanning direction is equal to or larger than a called width of A3 width when the image area is symmetrically divided at the center.

As for the laser exposure, laser exposure Lt is started when the rotational speed of the polygon mirror scanner reaches a predetermined rotational speed. Power of the laser lighting is outputted at the preceding power control value. When there is no preceding data, the power is outputted by using the program default value. As an image data level, the image area is set to FFhex solid printing. The length in the main scanning direction is equivalent to the width called A3 width when the image area is symmetrically divided at the center. That is, the laser beam scanning of a width including no adjustment tolerance for registration (lateral registration) in the main scanning direction is performed. In this instance, the power output of FFhex in the image area of 297 mm is performed.

The output time is equivalent to a period of time corresponding to the black band width. In this case, it is equivalent to a period of time corresponding to the length of the black band in the circumferential direction on the drum.

In order to accelerate the rise of the laser power before the data of FFhex is outputted, the bias current is supplied to slightly light on the laser light.

Subsequently, in the development, an (AC voltage+DC voltage) Dt are transferred. The AC voltage is transferred at a standard voltage and the DC voltage is transferred at the preceding DC control value. In the present embodiment, although the black band width has a DC control value of 280V, a DC control value for non-image area of 300V is outputted so as to completely cover the areas where the primary charge is outputted before and behind the black band width, thereby suppressing the reversal development in the area with the primary charge alone to the utmost. Although only the DC voltage is shown in FIG. 21, the AC voltage (not shown) is turned on in the area for further covering the area of the DC voltage (for non-image area). When there is no preceding data, the DC control value output is performed at the program default value. The output time is the black band width corresponding time. In this case, it is equivalent to the time corresponding to 100 mm in the circumferential direction on the drum. The DC value can be inputted on a scanning panel and is set so that the black band density can be varied.

Post-charge Ot supplies the charge to a black band toner to strengthen electrostatic cohesion, so that the adhesive force of the toner to the surface of the drum is raised to prevent the toner from scattering.

Further, separation charge Sdt raises the adhesive force of the toner to the drum surface.

Although the separation charge has the same polarity as that of the post-charge, since the voltage and current are generally large in order to eliminate the charge to separate the sheet from the drum, a separation charging application voltage as characteristics of the present invention in a state where no sheet exists between the drum and the separate charger is reduced and applied. According to the present embodiment, the normal voltage is set to 11.5 kVpp and the voltage at the reducing and applying time is set to 9.2 kVpp. The voltage is used to set a proper voltage in accordance with the form of the separate charger or printing speed of the image forming apparatus and is not limited to the numerical value in the present embodiment. Consequently, the leak in the separate charging shield can be prevented, and in addition, the charging wire disconnection, the black dot image due to the dot (fine pit) on a drum photosensitive layer, and image running due to overflow ozone can be prevented.

After the toner black band is formed on the drum, the step of running idle is performed until the pre-multi-rotation is finished. At the beginning of the step, the toner black band is conveyed to the drum cleaning device and dammed by the edge of a cleaning blade. The deposited toner scrapes a laminated material on the drum surface. Since the effect of scraping is proportional to a rubbing time, the rubbing time is assured as long as possible.

Subsequently, potential control steps are performed and shown by Pc, Lc, and Dc. Potentials on the high potential side and the low potential side detected by potential detecting means (not shown) by repeating the charge and the exposure under the conditions for each level are adjusted to predetermined values while the charging conditions and the exposing conditions are changed. During the potential control, the development bias sets the voltage so that the development is not performed.

The pre-multi-rotation is performed until the fixing thermistor temperature is set to 195° C. and is finished.

Referring to FIG. 21, when two continuous copy is performed after the standby state, ordinarily, preliminary charge for the pre-rotation starts. After running-in of about one cycle of the drum is finished, image area charge, image exposure, and image area developing bias application are performed to form the normal image (from an image leading edge It to an image trailing edge Ie in the two continuous copy). At that time, the separation voltage is controlled to a low voltage in the area where the sheet is not passed on the separate charger. It is also similarly performed in pre-multi-rotation Sdb, a portion between sheets Sdi, and post-rotation Sdt2 after the end of the image area. The low voltage is also effective in areas for toner black band formation Lt2, Dt2 in the post-rotation.

A method of correcting unevenness in the main scanning direction when the density unevenness of the developing device 7 or the other device occurs will now be described in detail hereinbelow.

Figures 7A, 7B, 7C:
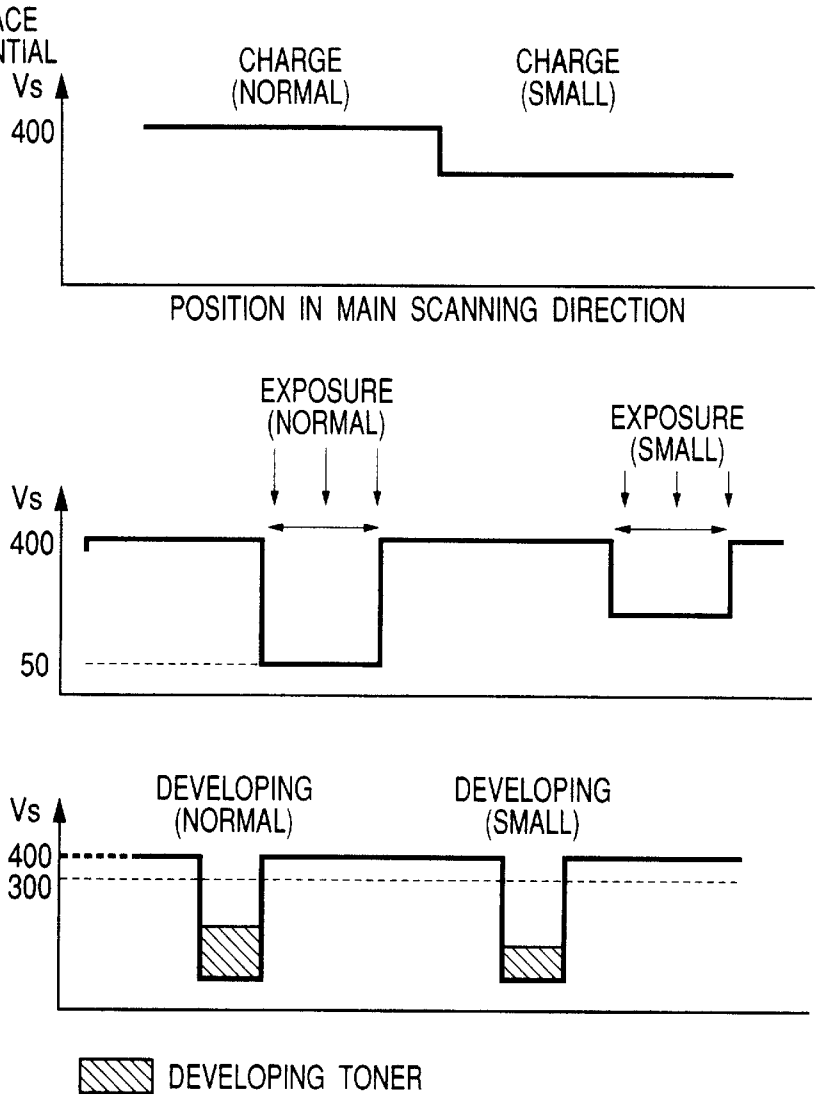
FIGS. 7A, 7B and 7C are schematic diagrams obtained by analyzing the main causes to generate density unevenness in the main scanning direction.

FIGS. 7A to 7C are schematic diagrams obtained by analyzing the main causes to generate the density unevenness in the main scanning direction. Each axis of ordinate denotes the surface potential on the photosensitive drum and each axis of abscissa indicates an arbitrary position in the main scanning direction.

Figure 8:
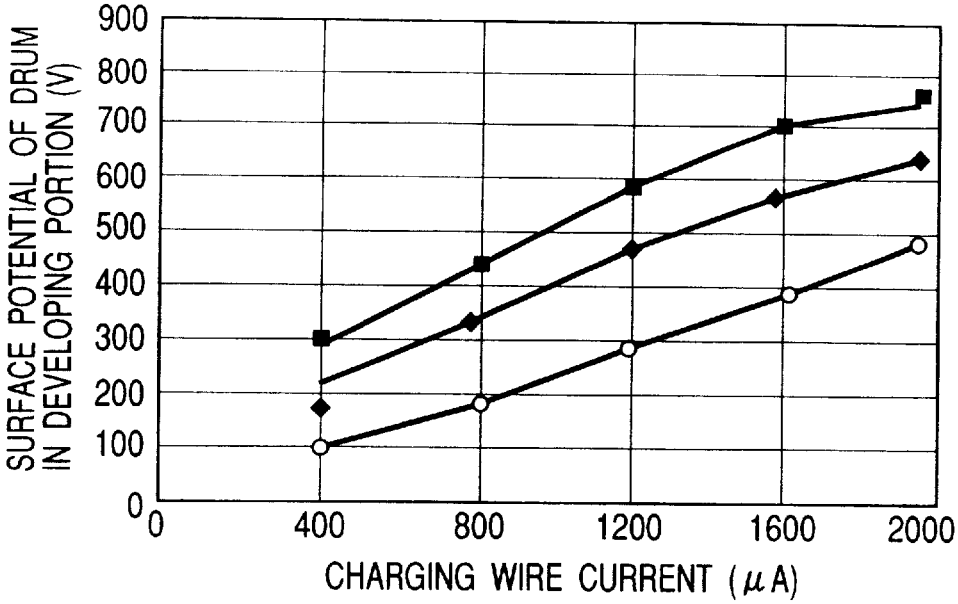
FIG. 8 is a graph showing a relation between a charging wire current and the surface potential of the drum.

FIG. 7A shows a location where the charge potential is normally held to 400V as a target potential and the potential of a location where the charge potential is smaller than the target potential. As shown by three kinds of characteristic curves in FIG. 8, it indicates surface potential unevenness generated because the chargeability characteristics of the photosensitive drum 1 are different from the characteristics of the surface potential obtained on the photosensitive drum 1 for the corona wire application current of the primary charger 2. Even when the chargeability characteristics of the photosensitive drum 1 are uniform, the surface potential unevenness occurs so long as the chargeability of the primary charger 2 is not uniform depending on the position in the main scanning direction.

Figure 9:
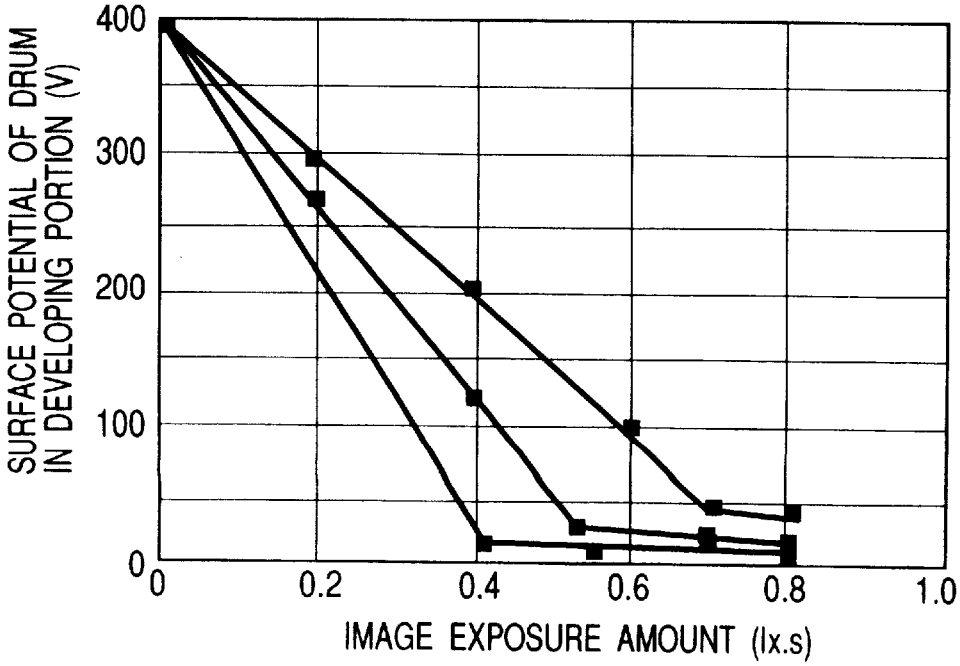
FIG. 9 is a graph showing a relation between an image exposure amount and the surface potential of the drum.

FIG. 7B shows a location where the potential is normally held to 50V as a target potential of the exposing position and the potential of a location where the potential is larger than the target potential in the case where the surface potential formation by charging is uniformly performed. As shown by three kinds of characteristic curves in FIG. 9, it indicates the surface potential unevenness generated because the abilities of photosensitive characteristics of the photosensitive drum 1 are various. Even when the photosensitive characteristics of the photosensitive drum 1 are uniform, the surface potential unevenness occurs so long as the light irradiation amount is not uniform depending on the position in the main scanning direction.

Figure 10:
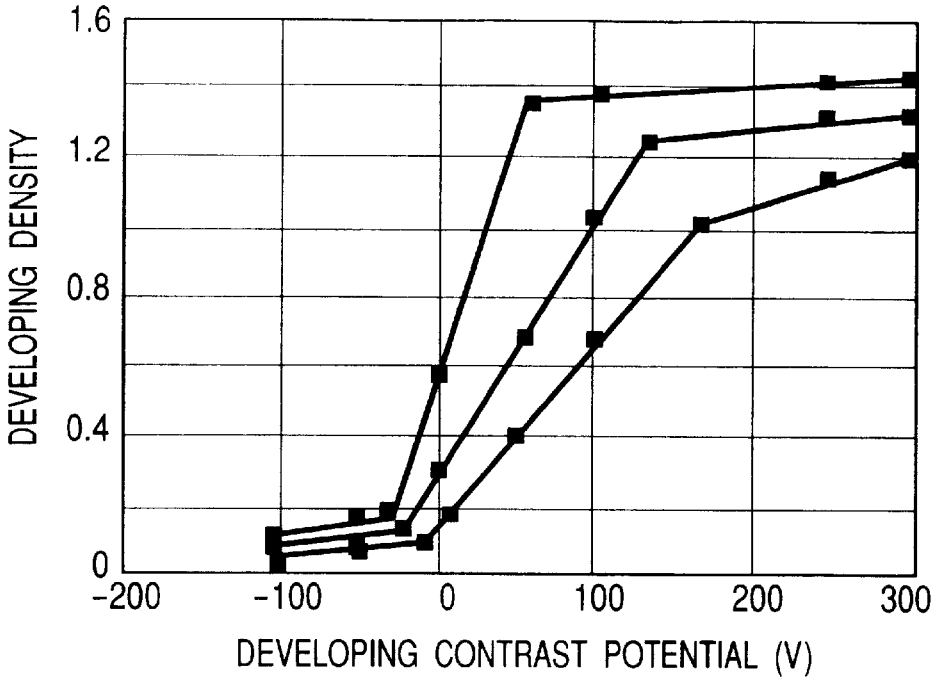
FIG. 10 is a graph showing a relation between a developing contrast potential and a developing density.

FIG. 7C shows a location where the development is normally performed at a potential of 50V in the exposing portion and a location where the potential is smaller than the target value in the case where the surface potential formation by charging and the surface potential formation by attenuation in potential due to the exposure are uniformly performed. As shown by three kinds of characteristics curves in FIG. 10, it indicates density unevenness generated because the abilities to develop for developing contrast as a difference between the surface potential of the photosensitive drum 1 and the DC voltage applied to the developing sleeve to bear and convey the developer are various. The density unevenness occurs in the case where the charge characteristics are not uniform in the main scanning direction or a gap between the photosensitive drum 1 and the developing sleeve is not uniform depending on the position in the main scanning direction.

There is also the density unevenness caused by the unevenness of the transfer efficiency upon transfer or separation in the main scanning direction (not shown).

In this case, all of the above causes to generate the unevenness are synthetically detected from a printout image and corrected.

Figure 12:
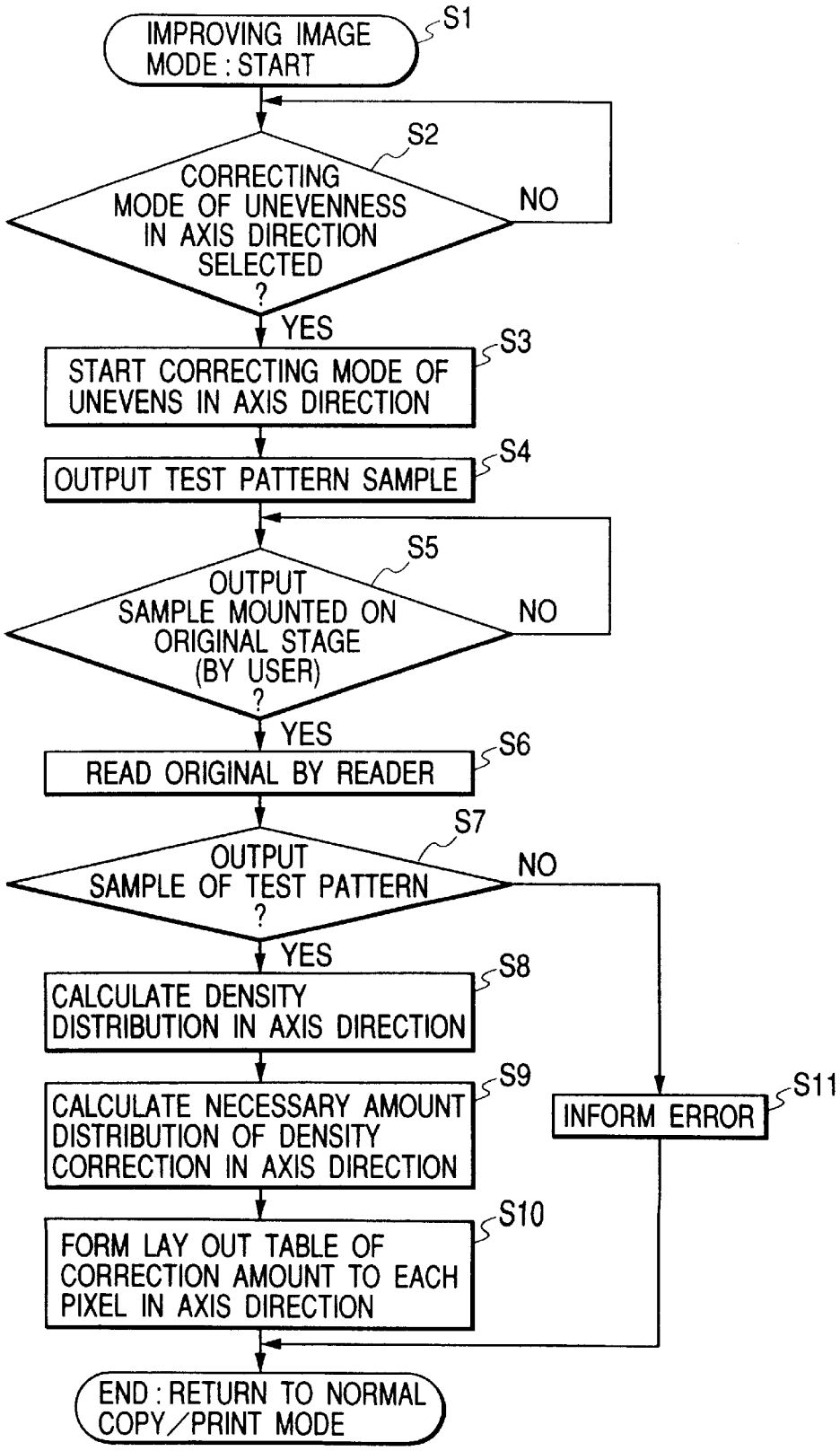
FIG. 12 is a flowchart showing the outline of the flow of a correcting operation.

FIG. 12 is a flowchart showing the outline of the flow of the correcting operation.

Step (S1)

The image forming apparatus of the present embodiment has an "improving image mode" as an improving mode of image unevenness in an input interface. The mode is first started.

Step (S2)

Next, a correcting mode of the unevenness in the axis direction (unevenness in the main scanning direction) is selected.

Step (S3)

A key to start the correcting mode of the unevenness in the axis direction is depressed to start the mode.

Step (S4)

Figure 11:
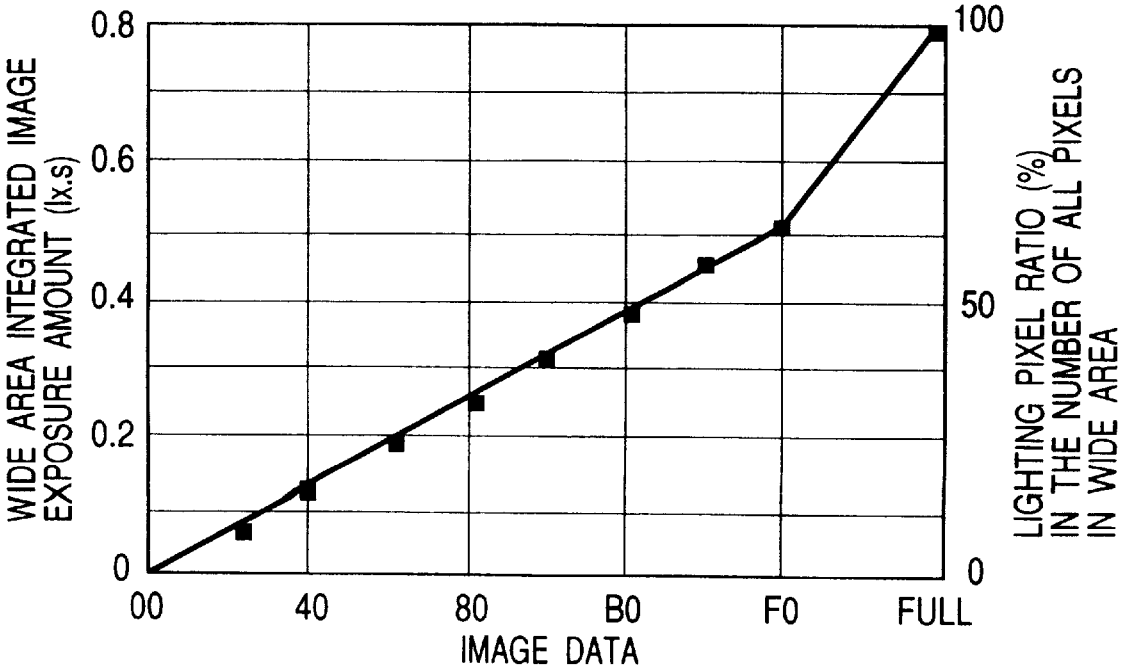
FIG. 11 is a graph showing a relation between image data and a wide area integrated image exposure amount.
Figure 13A:
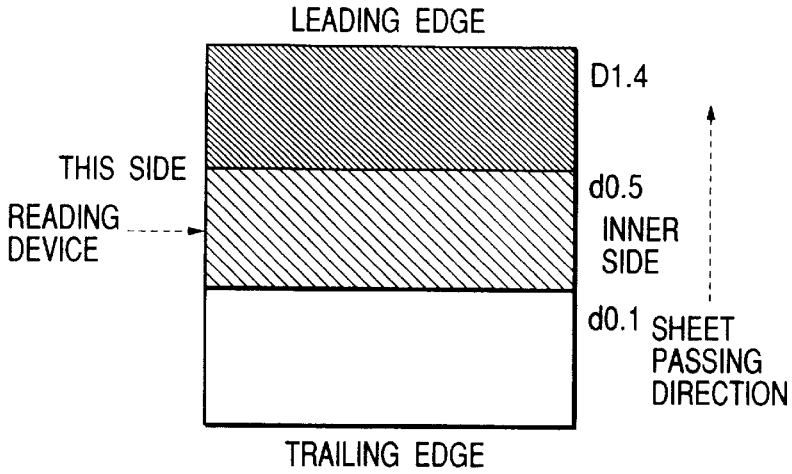
FIGS. 13A, 13B and 13C are diagrams showing test image samples, reading density, and correction necessary density.

The image forming apparatus outputs a test image sample as shown in FIG. 13A. As conditions to form the sample, in order to form images of complete solid black copy, halftone, blank copy, and the like the images are obtained under the primary charging conditions to form the above surface potentials, the exposure is performed under three kinds of image exposing conditions (F0, 80, and 00 hex in FIG. 11 in case of the 8-bit signal), development, transfer, and fixing are performed under the above-mentioned developing conditions to output the samples, and gradation density reproducing characteristics are detected by density characteristics detecting means (not shown).

Step (S5)

Each of the output samples is mounted on the original stage so as to set the leading edge and this side or inner side in the sheet passing direction to specific positions by the mode executor. Whether the mounting is completed is discriminated by original recognizing means (not shown).

Step (S6)

When the completion of the mounting is discriminated, the original is read by the reader as mentioned above. For the reading by the reader, it is desired to read at a resolution of about 400 to 600 dpi.

Step (S7)

Whether the original is a test image sample or not is discriminated on the basis of the discrimination of whether the density gradation has the same pattern as that of the sample or not. When it is discriminated that it is not the test image sample, an error is informed in step S11 and the present process is finished. In this case, the processing routine can be returned to the process in step S5.

Step (S8)

Figure 13B:
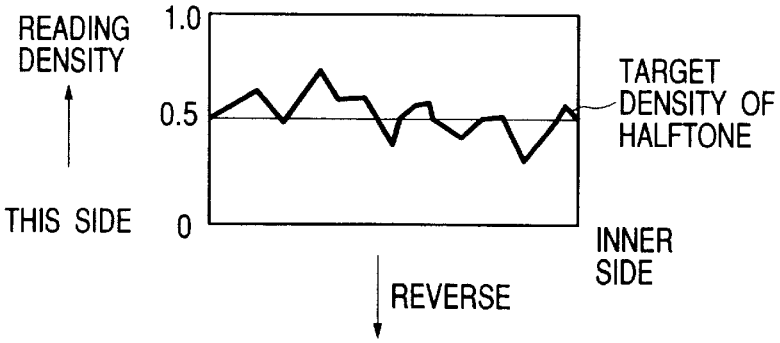

When it is discriminated that it is the test image sample, the density distribution in the axis direction is calculated as shown in FIG. 13B. When the test image samples are formed at F0, 80, 00 hex of the PWM level, a read density distribution in a halftone portion of 80 hex in which the unevenness can be most detected is calculated (the density distribution can also be calculated at F0, 80, and 00 hex, respectively).

Step (S9)

Figure 13C:
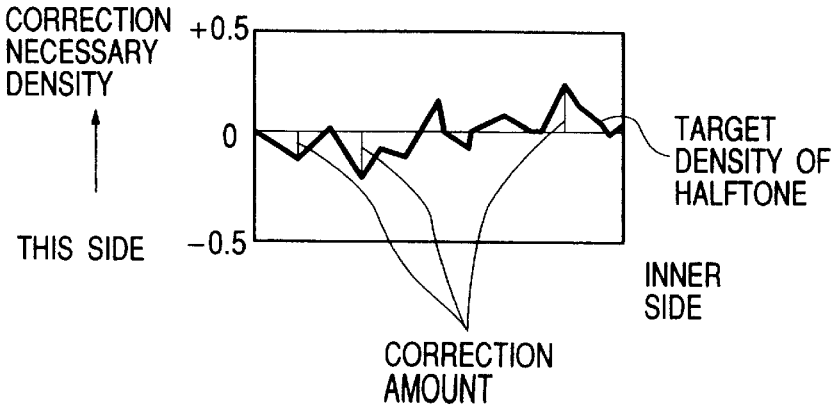

When the target density is set to 0.5 in FIG. 13B, increase and decrease amounts to 0.5 of the read density distribution in the halftone portion are calculated so as to correspond to each pixel in the main scanning direction. When minus correction is shown by a negative sign and plus correction is shown by a positive sign, as shown in FIG. 13C, a graph of necessary correction density obtained by reversing the polarity in FIG. 13B is derived.

Step (S10)

Figure 14:
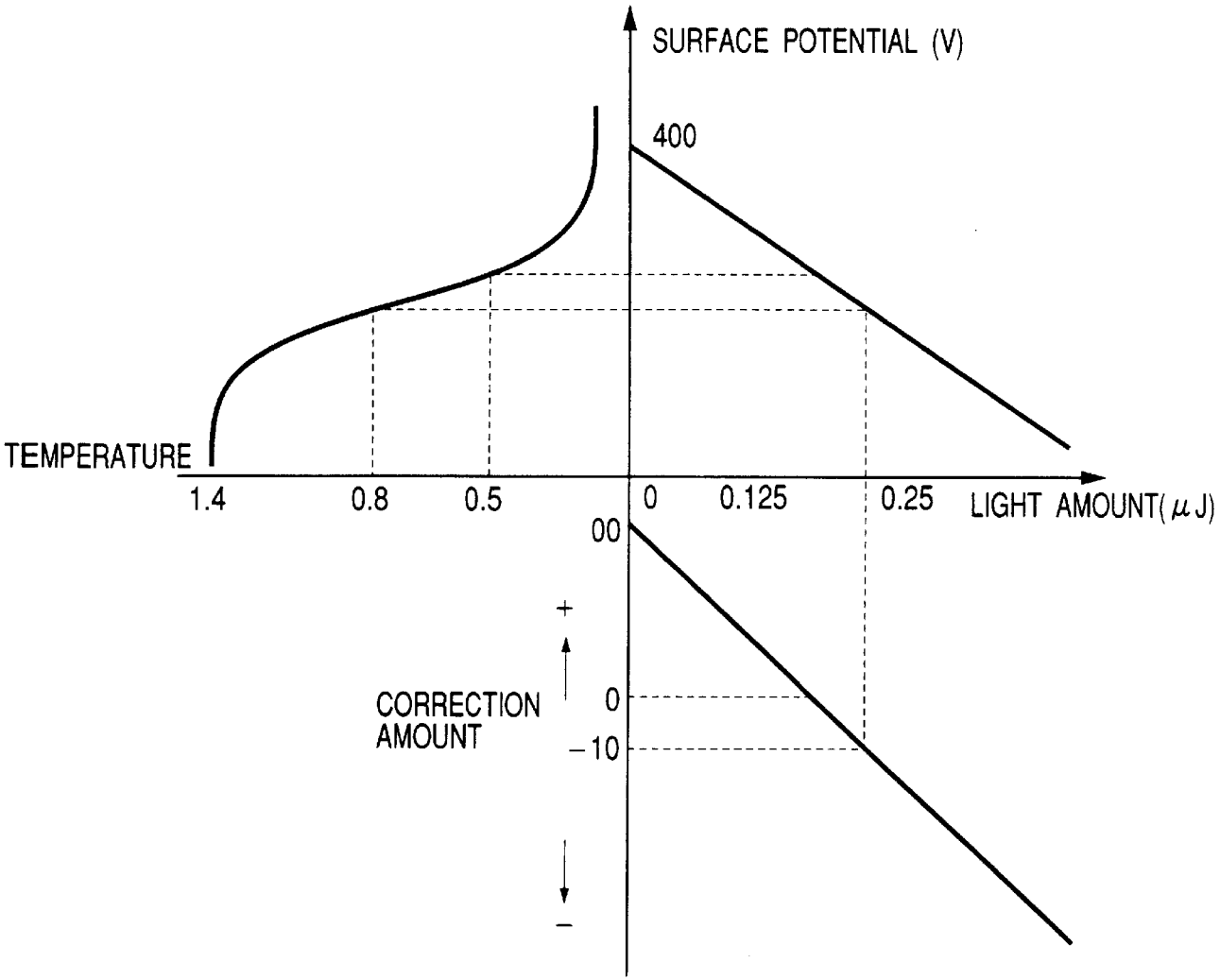
FIG. 14 is a graph for explaining a correction amount.

A correction light amount (correction level) to each pixel of the laser for dot exposure is obtained from the graph of the necessary correction density by referring to FIG. 14. For example, in the case where the necessary correction density is equal to +0.8 in FIG. 14, it is necessary to correct the surface potential by −200V, light amount on the surface of the photosensitive drum by +0.25 $\mu$J, and the image data by +80 hex. In this manner, the correction amount level corresponding to each pixel in the main scanning direction is allocated to form a correction table. In this instance, the mode is finished and the operation panel as an input interface unit of the image forming apparatus returns to the ordinary copying mode or printing mode.

When the correction amount corresponding to each pixel position in the main scanning direction is determined in this manner, it is stored into the correction table in a main scanning unevenness correcting circuit 50 (refer to FIG. 1) as correction value forming means.

Figure 20:
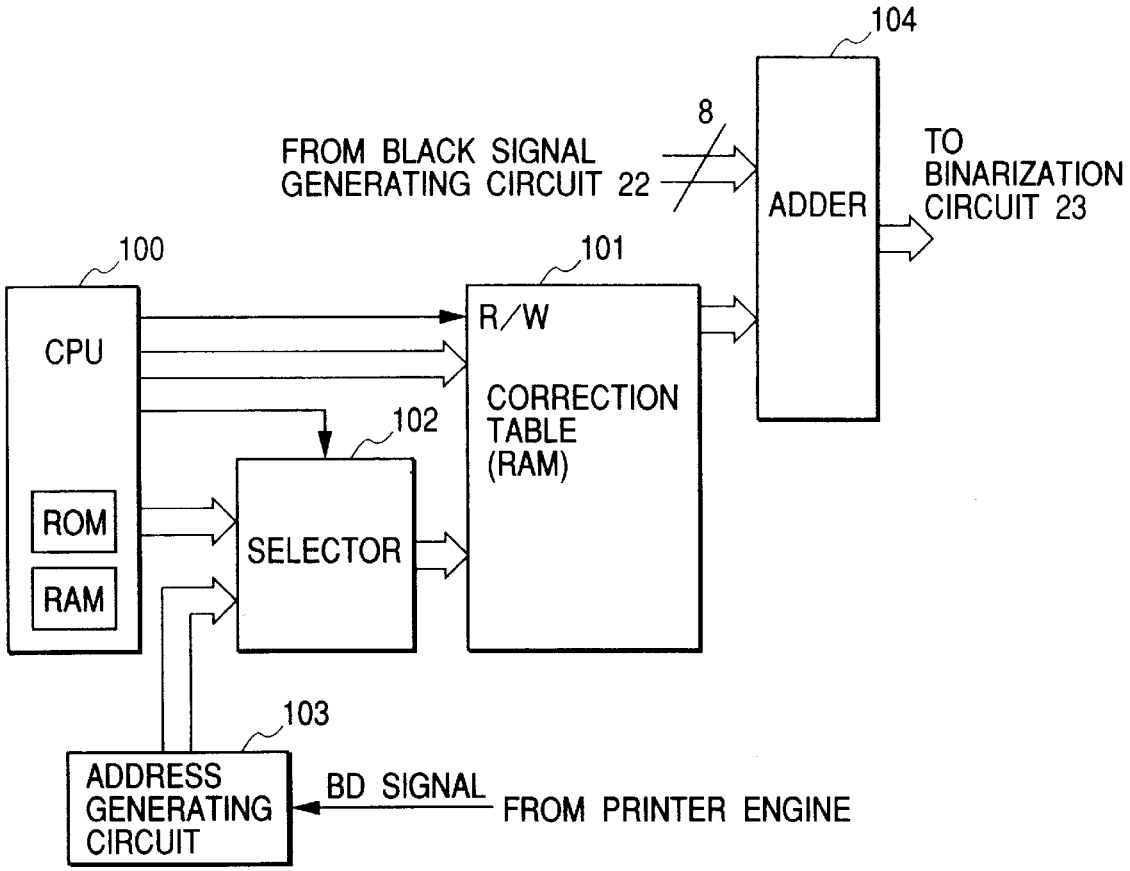
FIG. 20 is a diagram showing a specific circuit construction of a main scanning unevenness correcting circuit.

FIG. 20 shows the specific circuit construction of the main scanning unevenness correcting circuit 50 in the present embodiment.

The main scanning unevenness correcting circuit 50 comprises: a correction table 101; an adder 104, a selector 102; and address generating circuit 103, which are shown in the diagram. A CPU 100 is control means for controlling the whole of the present apparatus and has an ROM in which a control program for the copying machine or a program according to the flowchart of FIG. 12 previously described and an RAM which is used as a work area therein.

In the construction shown in the diagram, the correction table 101 has a capacity (nine bits per pixel and one bit of them denotes a plus or minus sign bit) corresponding to the number of pixels in at least the main scanning direction. As previously explained, correction data for each pixel formed on the basis of the image data obtained by reading the test image samples is written to a corresponding address position in the correction table (constructed by the RAM). Therefore, the CPU 100 outputs a signal to supply the address from the CPU 100 to the correction table 101 to the selector 102 and generates the address, data to be written, and a write signal to the correction table 101. When the writing of the correction data to all of the pixel positions in the main scanning direction is finished, the CPU 100 outputs a signal to select the address from the address generating circuit 103 to the selector 102 and outputs the read signal.

The address generating circuit 103 uses a beam detection signal set near the photosensitive drum 1 as a trigger and, at a predetermined time, sequentially outputs the address signal to the correction table 101 synchronously with a carrier clock of the image data from the black signal generating circuit 22. Consequently, the correction table 101 outputs the correction signal synchronously with the image data (pixel data) from the black signal generating circuit 22. The adder 104 adds the data from the correction table 101 to the image data from the black signal generating circuit 22 and generates the result to the binarization circuit 23. Since the positive and negative correction data has been stored in the correction table as previously described, the adder 104 generates the image data obtained by correcting the characteristics of the image data in accordance with the characteristics of the printer engine to the binarization circuit 23.

Although the description is reversed, the formation of the test image sample is performed in such a manner that the CPU 100 generates data of 00 hex, 80 hex, and F0hex every predetermined number of main scanning lines in place of the black signal generating circuit 22. Since it is the test image formation to know the characteristics of the printer engine, the data is not generated from the correction table 101 or data of 0 is always generated. When occasion demands, in the case where the test image sample is formed, 00 hex, 80 hex, and F0 hex are written into the correction table 101 at a proper timing and they can be outputted. In this instance, when the image reading is not performed, data of 0 is generated from the black signal generating circuit 22, so that the test image samples as previously shown can be formed. It is an advantage in this case that the test image samples can be formed with the construction alone of FIG. 20.

Since the data correction for the image unevenness or the like is performed at an 8-bit multi-value signal stage by using the correction table 101 as mentioned above, data without unevenness is formed at the binarizing time and the density unevenness is completely corrected at the laser writing time, so that the image having a fine quality without density unevenness in the longitudinal direction (main scanning direction) can be always provided. Particularly, according to the present embodiment, the density unevenness in a portion where the density is relatively low (highlight portion) can be suppressed.

When it is applied to the apparatus for forming images by the PWM system, the output of the adder 104 is D/A converted and is compared with a triangle wave from a triangle wave generating circuit, thereby forming a signal having a pulse width which depends on the density as shown in FIG. 4A to 4C. The signal can be supplied to the laser driving circuit 24. The reason why the pulse width signal is formed even when the density is equal to 0 is as previously described. The laser driving circuit 24 drives so as to generate the laser light for a period of time depending on the pulse width of the pulse width modulation signal.

As mentioned above, since no current leak occurs between the drum and the separation charge shield portion, even if the operating speed of the image forming apparatus is high, the total current amount for separation can be remarkably increased and the applied voltage can be increased, so that the separation performance can be extremely improved.

Particularly, in the case where the apparatus has been used for a long time, the paper particles of the transfer sheet or the scattered toners are deposited on the shield of the separate charger and stain the shield. Even when unevenness as discharge impedance occurs in a low potential shield portion as a discharge counter electrode, the leak does not occur, so that the stable separation performance can be assured in the use for a long time.

Since the leak does not occur in a high humidity environment as well, the stable separation performance can be assured in the use of each environment.

Further in the non-image area for a period of time during which the image is not formed, naturally, the leak does not occur and the preliminary rotating state or the like is easily selected depending on the use conditions, so that the apparatus performance becomes stable.

Additionally, for the failure derived by the leak, such a failure that the pit is formed on the photosensitive drum by the voltage attack at the leak time to generate a black dot or the discharging wire of the separate charger is disconnected can also be prevented.

Next, since a time to flow a large current is extremely reduced, a large amount of ozone product is not adhered on the photosensitive drum and the deterioration in image running does not occur in a high humidity environment. According to the above effects as mentioned above, in the image forming apparatus and digital printing machine such as high-speed network printer to which the printing-out at a high speed is requested, the stable separation performance and transfer sheet conveying performance can be obtained, and a stable high picture quality in which the density unevenness in the longitudinal direction (main scanning direction) does not always exist at high density influenced due to the environment and long use can be obtained.

Embodiment 2

Figure 15:
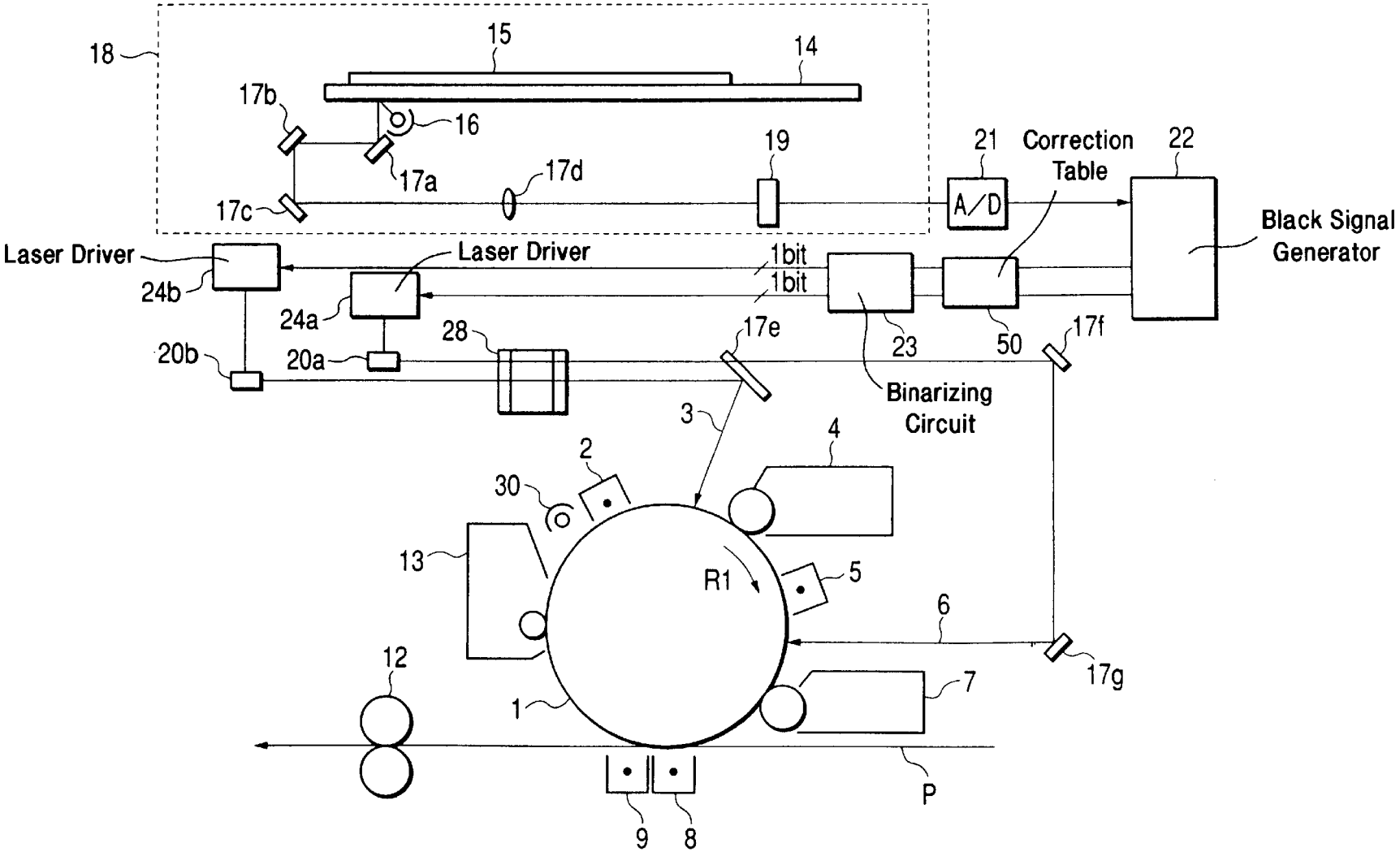
FIG. 15 is a longitudinal sectional view showing the schematic construction of an image forming apparatus of an embodiment 2.

FIG. 15 shows an embodiment 2 of the image forming apparatus according to the present invention. FIG. 15 is a longitudinal sectional view showing the schematic construction of the image forming apparatus.

The photosensitive drum 1 is formed by providing the photoconductive layer on the cylindrical conductive base member and is pivotably supported in the direction shown by the arrow R1 in the diagram. Around the photosensitive drum 1, in accordance with the order along the circumferential direction, the primary charger (first scorotron charger) 2 for uniformly charging the surface of the photosensitive drum 1, first exposing device 3 for reading original and exposing the photosensitive drum 1 on the basis of a first image signal that is proportional to the density of one of color images separated into two colors to form a first electrostatic latent image; a primary developing device for adhering the toner onto the first electrostatic latent image to form a first image, a re-charger (second scorotron charger) 5 for charging the photosensitive drum 1 after the first image is borne, a second exposing device 6 for performing the exposure of an amount obtained by adding a predetermined exposure amount to the exposure amount based on a second image signal that is proportional to the density of another separated color image to form a second electrostatic latent image, secondary developing device 7 for adhering the toner to the second electrostatic latent image to form a second image, transfer pre-charger 62 for charging a color-superposed image formed on the photosensitive drum 1 before the transfer, corona transfer charger (transfer charger) 8 for transferring the image to the transfer sheet P as a transfer material, electrostatic separate charger (separate charger) 9 for separating the transfer sheet P on which the color-superposed image has been transferred from the photosensitive drum 1, cleaning device 13 for removing the residual toner remained on the photosensitive drum 1 after the color-superposed image is transferred, and pre-exposing lamp 30 for eliminating the residual charge on the photosensitive drum 1 are arranged. The transfer sheet P on which the color-superposed image has been transferred is separated from the photosensitive drum 1 and, after that, conveyed to the fixing device 12. The toner image on the surface is fixed in the device to form a desired print image. The transfer sheet is discharged out of the image forming apparatus main body.

The transfer pre-charger 62 is directly connected to a connecting duct 61 and is further connected to a spraying fan 60.

The image scanner unit 18 reads the original 15 mounted on the original glass stage 14 by scanning the illuminating lamp 16 and converts image information into an electric signal by the photoelectric converting element 19. The reflected light from the original 15 scanned by the illuminating lamp 16 is introduced by the mirrors 17*a*, 17*b*, and 17*c* and is formed as an image by the lens 17*d* on the photoelectric converting element 19 having red, green, and blue filters therein. The electric signal in which red, green, and blue components have been generated by the photoelectric converting element 19 is converted into digital signals by the A/D converter 21. After that, the resultant signals are sent to a signal processing unit 22 as a color separating unit to be converted into image signals which are proportional to the image densities of the red and black components.

Figure 17:
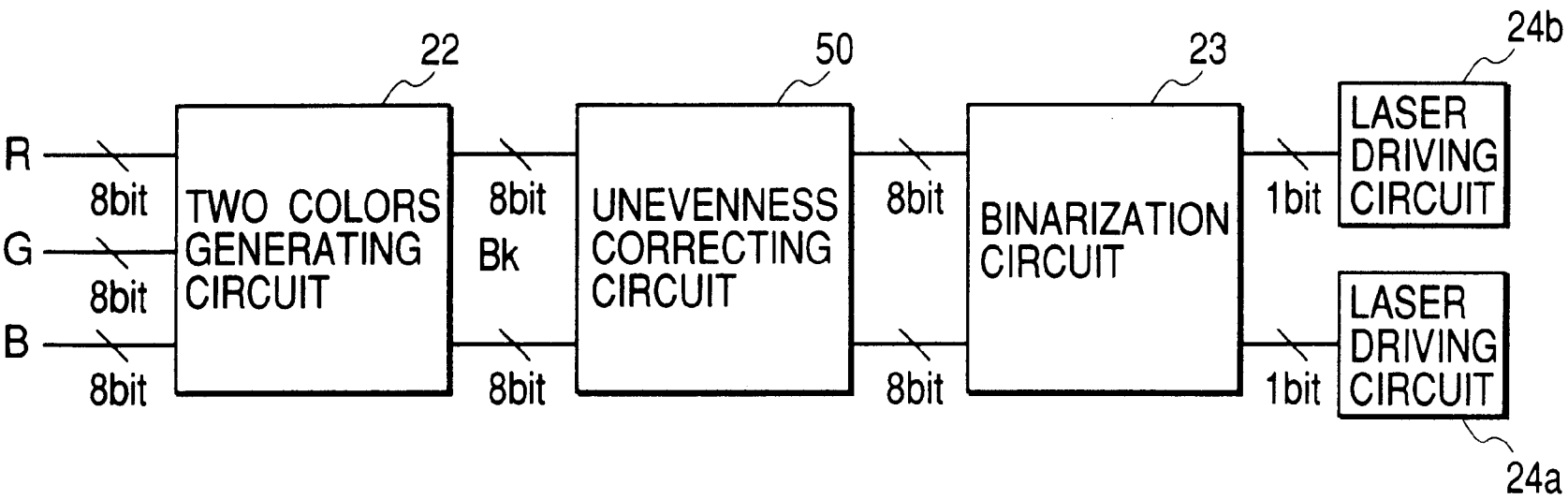
FIG. 17 is a block diagram showing an image process in the embodiment 2.

Correcting the image data is performed every pixel by the axis direction (main scanning direction) unevenness correcting circuit 50 (refer to reference numeral 50 in FIG. 17).

The red image signal (first image signal) and black image signal (second image signal) are sent to laser drivers 24*a* and 24*b* as signal generating units. The light emitting operations of lasers 20*a* and 20*b* are turned on/off in accordance with the red and black image signals. Laser light generated in accordance with the red signal writes a first electrostatic latent image as first image information to the photosensitive drum 1 through the polygon mirror 28 and a mirror 17*e*. Laser light generated in accordance with the black signal writes a second electrostatic latent image as second image information to the photosensitive drum 1 through the polygon mirror 28 and mirrors 17*f* and 17*g*.

In the present embodiment, an amorphous silicon drum is used as a photosensitive drum 1. The amorphous silicon drum has such characteristics that the durability is high and the duration of life is long.

FIGS. 16A to 16F are graphs for explaining the image forming process in the two color image forming mode in the present embodiment. FIGS. 16A to 16F show the processes, respectively. In each diagram, the surface potential of the photosensitive drum 1 is schematically shown.

Figure 16A:
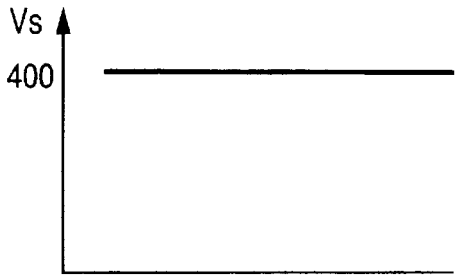
FIGS. 16A, 16B, 16C, 16D, 16E and 16F are schematic graphs for explaining an image forming process at the time of a two color image forming mode in the embodiment 2.

Referring to FIG. 16A, the photosensitive drum 1 is charged to, for example, +400V by the corona charger 2.

Figure 16D:
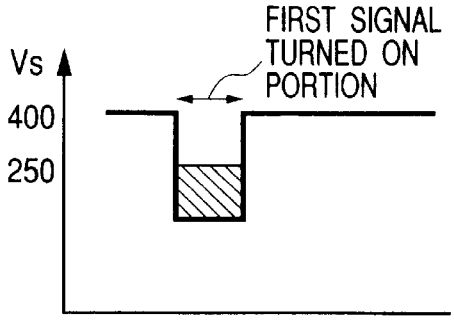
Figure 16B:
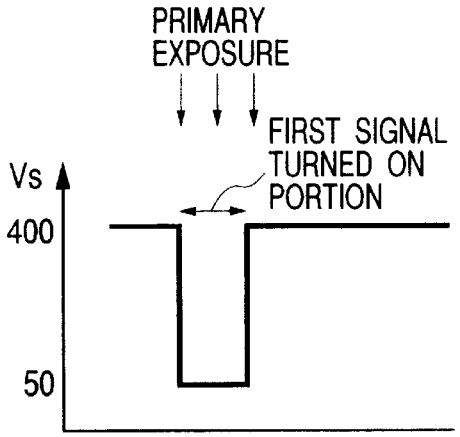

Referring to FIG. 16B, primary exposure of image information is performed. The surface potential of the exposing portion is attenuated to, for instance, +50V to form a first electrostatic latent image.

Figure 16E:
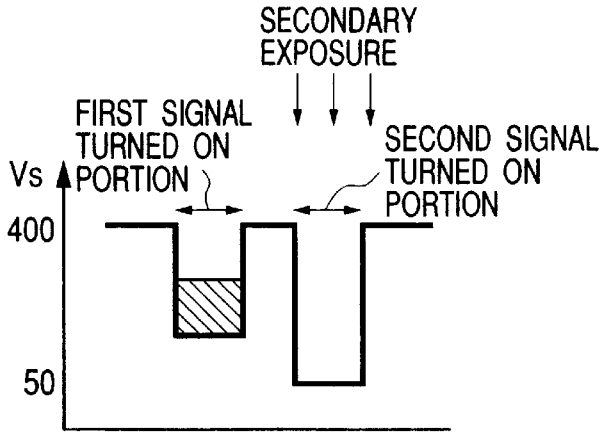
Figure 16C:
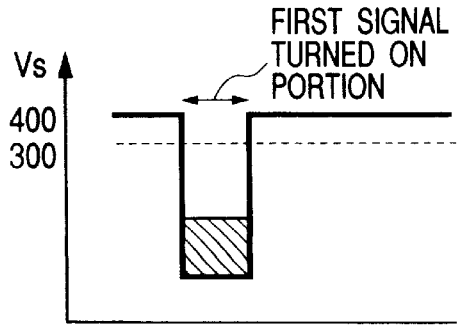
Figure 16F:
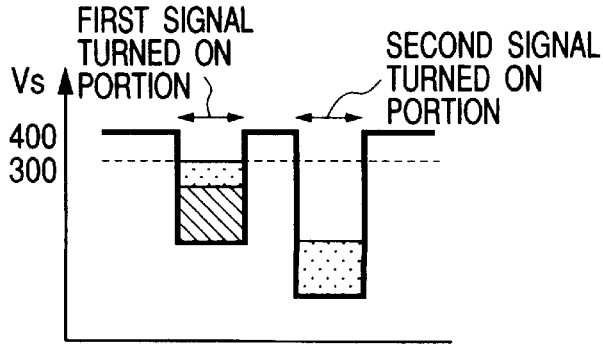
Figure 16F:
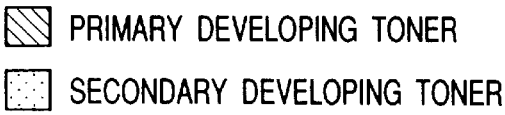

Next, in FIG. 16C, the developing bias voltage (for example, +300V: shown by a broken line) is applied to the developing sleeve of the primary developing device 4 to reversely develop the exposing portion.

Although re-charging is performed in FIG. 16D after the primary development, a voltage of 600V that is larger than 400V as a desired potential of a secondary developing position is applied to the grid of the re-charger 5 to control the primary developing non-image portion so as to be charged to, for example, 600V. At that time, the primary developing portion is charged to, for instance, 500V.

Next, referring to FIG. 16E, exposing is performed on the whole surface in accordance with second image information, an exposure amount being larger than in the case of a secondary developing monochrome mode by a predetermined exposure amount (e.g., an exposure amount to attenuate the primary developing non-image portion by 200V). At that time, in the primary developing portion, the potential is not attenuated more than the potential attenuation in the primary developing non-image portion by the foregoing exposing of a predetermined exposure amount, for example, it is attenuated only by 100V. This is because light cannot transmit through primary developer but it is scattered. The transmittance is set to 50%. A target potential after the re-charging of the primary developing non-image portion in which the surface potential after the exposure of a predetermined additional exposure amount of 0.25 $\mu$J in the secondary exposure is set to 400V as a secondary developing position target potential is set to 600V by assuming from the line of a well-known drum photosensitivity of 800V/$\mu$J. Next, since a known transmittance of the toner layer is still 50%, a light amount for the primary developing image portion which reaches the drum is equal to 0.125 $\mu$J. Similar to the above method, the target potential after the recharging of the primary developing image portion can be set to 500V.

In the present embodiment, although the semiconductor laser is used as secondary exposing means, complicated processes and the like are not needed in the secondary developing monochromatic mode and two color mode. Since the light amount of the laser is predetermined by the laser driving current, a predetermined offset current is added to the driving current of the secondary developing monochrome mode in the two color mode. That is, weak exposing is also performed in a portion where the second image signal is turned off, and also in the ON portion, the exposing is performed in an exposure amount additionally including about the same exposure amount as in the case of the above exposure. In this case, the potential of the primary developing image portion is set to 400V, the potential of the primary developing non-image portion is also set to 400V, and further, when the second image signal is turned on, the potential of the primary developing non-image portion is set to 50V. After that, a bias voltage of 300V is applied to a secondary developing sleeve in the developing process, so that secondary developer is not mixed to the primary developing portion or it is not developed to the primary and secondary developing non-image portions, and enough second image density can be obtained.

The separation leak preventing sequence in the non-sheet passing operation area as characteristics of the present invention will now be shown hereinbelow. The operation of the present invention will now be sequentially described with reference to FIG. 21.

The outline is that a separation charge voltage drops to a leak safety voltage in a state where the sheet does not pass on the charger.

FIG. 21 will now be described hereinbelow in accordance with the operating order. When the main power supply switch is turned on and it is detected that a fixing thermistor temperature is equal to 100° C. or less and water content W≧9 g in a specific water content area in the environment, it is discriminated that it is a state of the first run in the morning in a high humidity environment. The drum motor and main driving motor (main motor) which are shown by Hr are operated to allow the drum to run idle. Simultaneously, the pre-exposure lighting Hi is performed and, further, the cleaner system driving system (not shown) (it is driven by the same driving as that of the main motor) is operated to perform the rotation of the sleeve of the developing device.

In this instance, the drum deposit scraping sequence to supply developer to the drum is performed.

The sequence performs the primary charge Pt to a position on the drum corresponding to the pre-exposing position. As a charge amount, a control value of the previous day, namely, the last potential control value when the preceding power supply is in a current supply state is used to generate the power output. When there is no preceding data, the power output is performed by using a program default value. The output time is equivalent to a period of time corresponding to a black band width or more. There is an excessive charge area (surplus of about 10 mm) before and behind the black band. For a period of time corresponding to the normal black band width, in total, for a period of time corresponding to 100 mm or more in the circumferential direction on the drum, the charge is performed.

Charging is performed to a portion where the length in the main scanning direction is equal to or larger than a called width of A3 width when the image area is symmetrically divided at the center.

As for the laser exposure, laser exposure Lt is started when the rotational speed of the polygon mirror scanner reaches a predetermined rotational speed. Power of the laser lighting is outputted at the preceding power control value. When there is no preceding data, the power is outputted by using the program default value. As an image data level, the image area is set to FFhex solid printing. The length in the main scanning direction is equivalent to the width called A3 width when the image area is symmetrically divided at the center. That is, the laser beam scanning of a width including no adjustment tolerance for registration (lateral registration) in the main scanning direction is performed. In this instance, the power output of FFhex in the image area of 297 mm is performed.

The output time is equivalent to a period of time corresponding to the black band width. In this case, it is equivalent to a period of time corresponding to the length of the black band in the circumferential direction on the drum.

In order to accelerate the rise of the laser power before the data of FFhex is outputted, the bias current is supplied to slightly light on the laser light.

Subsequently, in the development, the AC voltage+DC voltage Dt is transferred. The AC voltage is transferred at a standard voltage and the DC voltage is transferred at the preceding DC control value. In the present embodiment, although the black band width has a DC control value of 280V, a DC control value for non-image area of 300V is outputted so as to completely cover the areas where the primary charge is outputted before and behind the black band width, thereby suppressing the reversal development in the area with the primary charge alone to the utmost. Although only the DC voltage is shown in FIG. 21, the AC voltage (not shown) is turned on in the area for further covering the area of the DC voltage (for non-image area). When there is no preceding data, the DC control value output is performed at the program default value. The output time is the black band width corresponding time. In this case, it is equivalent to the time corresponding to 100 mm in the circumferential direction on the drum. The DC value can be inputted on a scanning panel and is set so that the black band density can be varied.

The post-charge Ot supplies the charge to a black band toner to strengthen electrostatic cohesion, so that the adhesive force of the toner to the surface of the drum is raised to prevent the toner from scattering.

Although the separation charge has the same polarity as that of the post-charge, since the voltage and current are generally large in order to eliminate the charge to separate the sheet from the drum, a separation charging application voltage as characteristics of the present invention in a state where no sheet exists between the drum and the separate charger is reduced and applied. According to the present embodiment, the normal voltage is set to 11.5 kVpp and the voltage at the reducing and applying time is set to 9.2 kVpp. The voltage is used to set a proper voltage in accordance with the form of the separate charger or printing speed of the image forming apparatus and is not limited to the numerical value in the present embodiment. Consequently, the leak in the separate charging shield can be prevented, and in addition, the charging wire disconnection, the black dot image due to the fine pit on a drum photosensitive layer, and image running due to overflow ozone can be prevented.

After the toner black band is formed on the drum, the step of running idle is performed until the pre-multi-rotation is finished. At the beginning of the step, the toner black band is conveyed to the drum cleaning device and dammed by the edge of a cleaning blade. The deposited toner scrapes a laminated material on the drum surface. Since the effect of scraping is proportional to a rubbing time, the rubbing time is assured as long as possible.

Subsequently, the potential control steps are performed and shown by Pc, Lc, and Dc. Potentials on the high potential side and the low potential side detected by potential detecting means (not shown) by repeating the charge and the exposure under the conditions for each level are adjusted to predetermined values while the charging conditions and the exposing conditions are changed. During the potential control, the development bias sets the voltage so that the development is not performed.

The pre-multi-rotation is performed until the fixing thermistor temperature is set to 195° C. and is finished.

Referring to FIG. 21, when the two continuous copy is performed after the standby state, ordinarily, preliminary charge for the pre-rotation starts. After running-in of about one cycle of the drum is finished, image area charge, image exposure, and image area developing bias application are performed to form the normal image (from the image leading edge It to the image trailing edge Ie in the two continuous copy). At that time, the separation voltage is controlled to a low voltage in the area where the sheet is not passed on the separate charger. It is also similarly performed in the pre-multi-rotation Sdb, portion between sheets Sdi, and post-rotation Sdt2 after the end of the image area. The low voltage is also effective in areas for toner black band formation Lt2, Dt2 in the post-rotation.

The correcting method of the unevenness in the main scanning direction when the density unevenness of the developing device or the other device occurs will now be described in detail hereinbelow.

Similar to the embodiment 1, explanation will be made by using the flowchart of the forming operation of the correction table 50 in FIG. 12.

(1) The image forming apparatus of the present embodiment has the "improving image mode" as an improving mode of image unevenness in an input interface. The mode is first started.

(2) Next, the correcting mode of the unevenness in the axis direction (unevenness in the main scanning direction) is selected.

(3) The key to start the correcting mode of the unevenness in the axis direction is depressed to start the mode.

(4) The image forming apparatus outputs a test image sample as shown in FIG. 13A. As conditions to form the sample, in order to form images of complete solid black copy, halftone, blank copy, and the like the images are obtained under the primary charging conditions to form the above surface potentials, the exposure is performed under three kinds of image exposing conditions (F0, 80, and 00 hex in FIG. 11), development, transfer, and fixing are performed under the above-mentioned developing conditions to output the samples.

In the present embodiment, a test image sample output is effected per two colors, for example red and black. After the output, the following operation of the (5) to (10) is effected per colors of red and black.

(5) The output samples is mounted on the original stage so as to set the leading edge and this side or inner side in the sheet passing direction to specific positions by the mode executor. Whether the mounting is completed is discriminated by original recognizing means (not shown).

(6) When the completion of the mounting is discriminated, the original is read by the reader as mentioned above. For the reading by the reader, it is desired to read at a resolution of about 400 to 600 dpi.

(7) Whether the original is a test image sample or not is discriminated on the basis of the discrimination of whether the density gradation has the same pattern as that of the sample or not.

(8) When it is discriminated that it is the test image sample, the density distribution in the axis direction is calculated as shown in FIG. 13B. When the test image samples are formed at F0, 80, 00 hex of the PWM level, a read density distribution in a halftone portion of 80 hex in which the unevenness can be most detected is calculated (the density distribution can also be calculated at F0, 80, and 00 hex, respectively).

(9) When the target density is set to 0.5 in FIG. 13B, increase and decrease amounts to 0.5 of the read density distribution in the halftone portion are calculated so as to correspond to each pixel in the main scanning direction. When minus correction is shown by a negative sign and plus correction is shown by a positive sign, as shown in FIG. 13C, a graph of necessary correction density obtained by reversing the polarity in FIG. 13B is derived.

(10) A correction light amount (correction level) to each pixel of the laser for dot exposure is obtained from the graph of the necessary correction density by referring to FIG. 14. For example, in the case where the necessary correction density is equal to +0.8 in FIG. 14, it is necessary to correct the surface potential by −200V, light amount on the surface of the photosensitive drum by +0.25 $\mu$J, and the image data by +80 hex. In this manner, the correction amount level corresponding to each pixel in the main scanning direction is allocated to form a correction table. In this instance, the mode is finished and the operation panel as an input interface unit of the image forming apparatus returns to the ordinary copying mode or printing mode.

As mentioned above, since no current leak occurs between the drum and the separation charge shield portion, even if the operating speed of the image forming apparatus is high, the total current amount for separation can be remarkably increased and the applied voltage can be increased, so that the separation performance can be extremely improved.

Particularly, in the case where the apparatus has been used for a long time, the paper particles of the transfer sheet or the scattered toners are deposited on the shield of the separate charger and stain the shield. Even when unevenness as discharge impedance occurs in a low potential shield portion as a discharge counter electrode, the leak does not occur, so that the stable separation performance can be assured in the use for a long time.

Since the leak does not occur in a high humidity environment as well, the stable separation performance can be assured in the use of each environment.

Further in the non-image area for a period of time during which the image is not formed, naturally, the leak does not occur and the preliminary rotating state or the like is easily selected depending on the use conditions, so that the apparatus performance becomes stable.

Additionally, for the failure derived by the leak, such a failure that the pit is formed on the photosensitive drum by the voltage attack at the leak time to generate a black dot or the discharging wire of the separate charger is disconnected can also be prevented.

Next, since a time to flow a large current is extremely reduced, a large amount of ozone product is not adhered on the photosensitive drum and the deterioration in image running does not occur in a high humidity environment. According to the above effects as mentioned above, in the image forming apparatus and digital printing machine such as high-speed network printer to which the printing-out at a high speed is requested, the stable separation performance and transfer sheet conveying performance can be obtained, and a stable high picture quality in which the density unevenness in the longitudinal direction (main scanning direction) does not always exist at high density influenced due to the environment and long use can be obtained.

Embodiment 3

Figure 18:
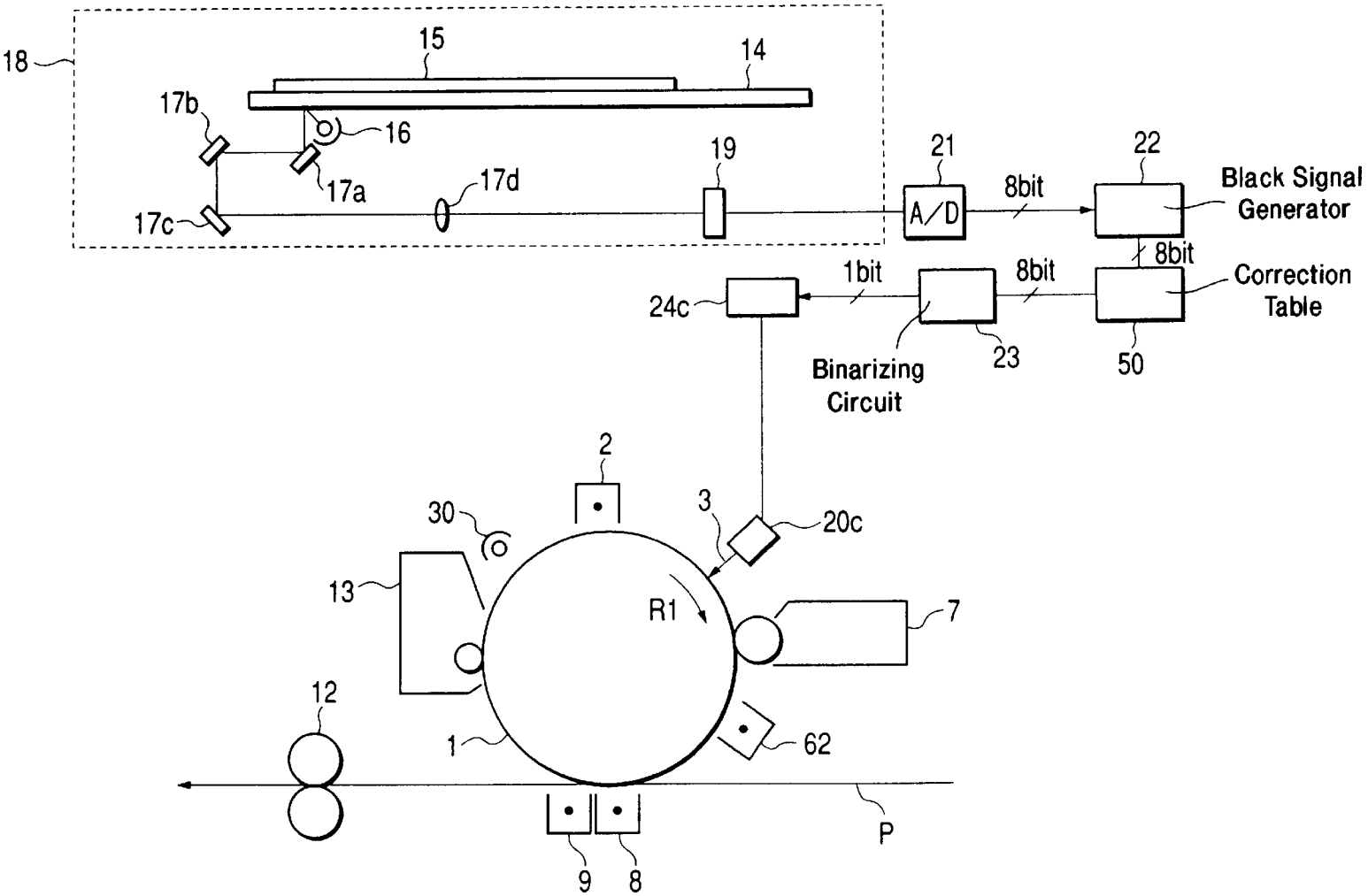
FIG. 18 is a longitudinal sectional view showing the schematic construction of an image forming apparatus of an embodiment 3.
Figure 19:
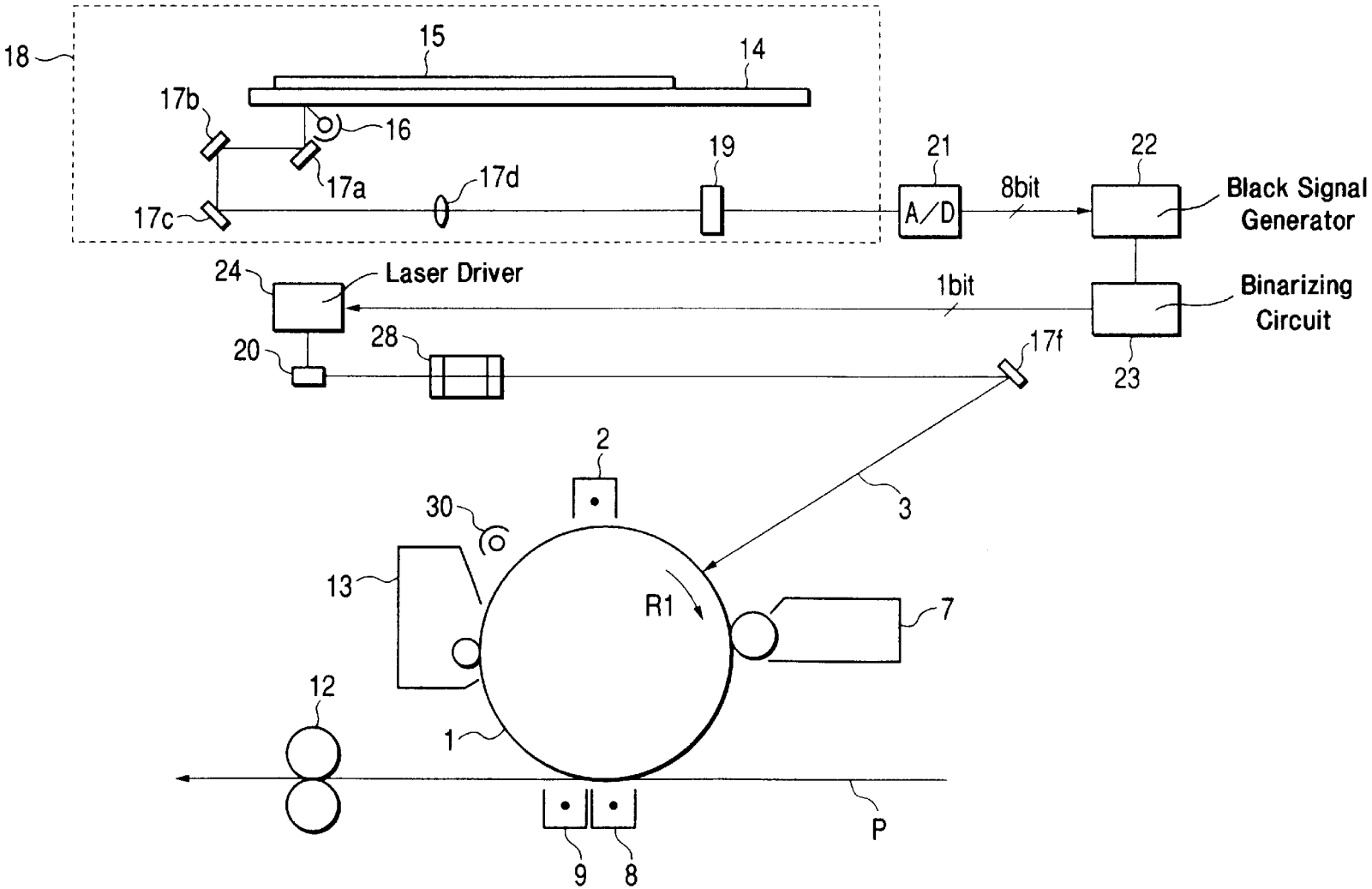
FIG. 19 is a longitudinal sectional view showing the schematic construction of a conventional image forming apparatus.

FIG. 18 is a schematic constructional diagram of an embodiment 3 of the image forming apparatus according to the present invention.

The photosensitive drum 1 is constructed by forming a photoconductive layer on a cylindrical conductive base member and is pivotably supported in the direction shown by the arrow R1 in the diagram. Around the photosensitive drum 1, in accordance with the order along the circumferential direction, the scorotron charger (primary charger) 2 for uniformly charging the surface of the photosensitive drum 1, exposing device 3 for reading original and exposing the photosensitive drum 1 on the basis of an image signal that is proportional to the density of an image to form an electrostatic latent image, developing device 7 for developing the electrostatic latent image as a toner image by adhering toner to the latent image, post-charger (transfer pre-charger) 62 for charging the toner image before the transfer, corona transfer charger (transfer charger) 8 for transferring the toner image formed on the photosensitive drum 1 to the transfer sheet P as a transfer material, electrostatic separate charger (separate charger) 9 for separating the transfer sheet P on which the toner image has been transferred from the photosensitive drum 1, cleaning device 13 for removing the residual toner remained on the photosensitive drum 1 after the toner image is transferred, and pre-exposing lamp 30 for eliminating the residual charge on the photosensitive drum 1 are arranged. The transfer sheet P on which the toner image has been transferred is separated from the photosensitive drum 1 and, after that, conveyed to the fixing device 12. The toner image on the surface is fixed in the device to form a desired print image. The transfer sheet is discharged out of the image forming apparatus main body.

In the reader unit 18, light is irradiated to the original 15 stacked on the original glass stage 14 by the illuminating lamp 16 and reflected light is formed as an image on the photoelectric converting element (one-line CCD) 19, thereby converting the image into an electric signal corresponding to image information. The reflected light from the original 15 irradiated by the illuminating lamp 16 is introduced by the mirrors 17*a*, 17*b*, and 17*c* and is formed as an image on the photoelectric converting element 19 by the lens 17*d*. The electric signal generated by the photoelectric converting element 19 is A/D converted by the A/D converter 21 to set digital image data of eight bits. After that, in order to convert luminance information into density information by the black signal generating circuit 22, the data is logarithmically converted and the resultant data is set to image density data.

Figure 3:
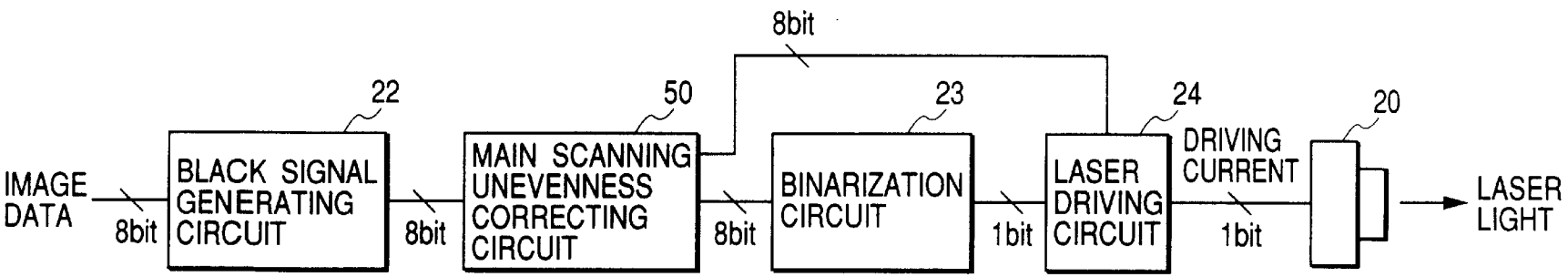
FIG. 3 is a block diagram showing an image process in the embodiment 1.

As shown in FIG. 1 or 3, the image density data is corrected every pixel in the main scanning direction by the main scanning unevenness correcting circuit 50 of the present invention. The correcting method of the main scanning unevenness correcting circuit will be described in detail hereinlater.

The 8-bit digital image data signal formed as mentioned above is inputted to an LED driving circuit 24*c* (refer to FIG. 18) as characteristics of the present invention. The LED driving circuit 24*c* is a well-known PWM circuit and modulates a light emitting time to turn on/off an LED as a luminance emitting device 20*c* in accordance with the level of the inputted image density signal. A plurality of luminance emitting devices 20*c* are arranged in the main scanning direction.

LED light driven and emitted in accordance with the image signal as mentioned above is written to the photosensitive drum 1 to form a digital electrostatic latent image as image information.

In the present embodiment, an amorphous silicon drum is used as a photosensitive drum 1. The amorphous silicon drum has such characteristics that the stability of the features of the conductive base member is high, the durability is high, and the duration of life is long.

The separation leak preventing sequence in the non-sheet passing operation area as characteristics of the present invention will now be shown hereinbelow. The operation of the present invention will now be sequentially described with reference to FIG. 21.

The outline is that a separation charge voltage deteriorates to a leak safety voltage in a state where the sheet does not pass on the charger.

FIG. 21 will now be described hereinbelow in accordance with the operating order. When the main power supply switch is turned on and it is detected that a fixing thermistor temperature is equal to 100° C. or less and water content W≧9 g in a specific water content area in the environment, it is discriminated that it is a state of the earliest morning in a high humidity environment. The drum motor and main driving motor (main motor) which are shown by Hr are operated to allow the drum to run idle. Simultaneously, the pre-exposure lighting H1 is performed and, further, the cleaner system driving system (not shown) (it is driven by the same driving as that of the main motor) is operated to perform the rotation of the sleeve of the developing device.

In this instance, the drum deposit scraping sequence to supply developer to the drum is performed.

The sequence performs the primary charge Pt to a position on the drum corresponding to the pre-exposing position. As a charge amount, a control value of the previous day, namely, the last potential control value when the preceding power supply is in a current supply state is used to generate the power output. When there is no preceding data, the power output is performed by using a program default value. The output time is equivalent to a period of time corresponding to a black band width or more. There is an excessive charge area (surplus of about 10 mm) before and behind the black band. For a period of time corresponding to the normal black band width, in total, for a period of time corresponding to 100 mm or more in the circumferential direction on the drum, the charge is performed.

Charging is performed to a portion where the length in the main scanning direction is equal to or larger than a called width of A3 width when the image area is symmetrically divided at the center.

As for the laser exposure, laser exposure Lt is started when the rotational speed of the polygon mirror scanner reaches a predetermined rotational speed. Power of the laser lighting is outputted at the preceding power control value. When there is no preceding data, the power is outputted by using the program default value. As an image data level, the image area is set to FFhex solid printing. The length in the main scanning direction is equivalent to the width called A3 width when the image area is symmetrically divided at the center. That is, the laser beam scanning of a width including no adjustment tolerance for registration (lateral registration) in the main scanning direction is performed. In this instance, the power output of FFhex in the image area of 297 mm is performed.

The output time is equivalent to a period of time corresponding to the black band width. In this case, it is equivalent to a period of time corresponding to the length of the black band in the circumferential direction on the drum.

In order to accelerate the rise of the laser power before the data of FFhex is outputted, the bias current is supplied to slightly light on the laser light.

Subsequently, in the development, the AC voltage+DC voltage Dt is transferred. The AC voltage is transferred at a standard voltage and the DC voltage is transferred at the preceding DC control value. In the present embodiment, although the black band width has a DC control value of 280V, a DC control value for non-image area of 300V is outputted so as to completely cover the areas where the primary charge is outputted before and behind the black band width, thereby suppressing the reversal development in the area with the primary charge alone to the utmost. Although only the DC voltage is shown in FIG. 21, the AC voltage (not shown) is turned on in the area for further covering the area of the DC voltage (for non-image area). When there is no preceding data, the DC control value output is performed at the program default value. The output time is the black band width corresponding time. In this case, it is equivalent to the time corresponding to 100 mm in the circumferential direction on the drum. The DC value can be inputted on a scanning panel and is set so that the black band density can be varied.

The post-charge Ot supplies the charge to a black band toner to strengthen electrostatic cohesion, so that the adhesive force of the toner to the surface of the drum is raised to prevent the toner from scattering.

Although the separation charge has the same polarity as that of the post-charge, since the voltage and current are generally large in order to eliminate the charge to separate the sheet from the drum, a separation charging application voltage as characteristics of the present invention in a state where no sheet exists between the drum and the separate charger is reduced and applied. According to the present embodiment, the normal voltage is set to 11.5 kVpp and the voltage at the reducing and applying time is set to 9.2 kVpp. The voltage is used to set a proper voltage in accordance with the form of the separate charger or printing speed of the image forming apparatus and is not limited to the numerical value in the present embodiment. Consequently, the leak in the separate charging shield can be prevented, and in addition, the charging wire disconnection, the black dot image due to the fine pit on a drum photosensitive layer, and image running due to overflow ozone can be prevented.

After the toner black band is formed on the drum, the step of running idle is performed until the pre-multi-rotation is finished. At the beginning of the step, the toner black band is conveyed to the drum cleaning device and dammed by the edge of a cleaning blade. The deposited toner scrapes a laminated material on the drum surface. Since the effect of scraping is proportional to a rubbing time, the rubbing time is assured as long as possible.

Subsequently, the potential control steps are performed and shown by Pc, Lc, and Dc. Potentials on the high potential side and the low potential side detected by potential detecting means (not shown) by repeating the charge and the exposure under the conditions for each level are adjusted to predetermined values while the charging conditions and the exposing conditions are changed. During the potential control, the development bias sets the voltage so that the development is not performed.

The pre-multi-rotation is performed until the fixing thermistor temperature is set to 195° C. and is finished.

Referring to FIG. 21, when the two continuous copy is performed after the standby state, ordinarily, preliminary charge for the pre-rotation starts. After running-in of about one cycle of the drum is finished, image area charge, image exposure, and image area developing bias application are performed to form the normal image (from the image leading edge It to the image trailing edge Ie in the two continuous copy). At that time, the separation voltage is controlled to a low voltage in the area where the sheet is not passed on the separate charger. It is also similarly performed in the pre-multi-rotation Sdb, portion between sheets Sdi, and post-rotation Sdt2 after the end of the image area. The low voltage is also effective in areas for toner black band formation Lt2, Dt2 in the post-rotation.

The correcting method of the unevenness in the main scanning direction when the density unevenness of the developing device or the other device occurs will now be described in detail hereinbelow.

Similar to the embodiment 1, explanation will be made by using the flowchart of the forming operation of the correction table 50 in FIG. 12.

(1) The image forming apparatus of the present embodiment has the "improving image mode" as an improving mode of image unevenness in an input interface. The mode is first started.

(2) Next, the correcting mode of the unevenness in the axis direction (unevenness in the main scanning direction) is selected.

(3) The key to start the correcting mode of the unevenness in the axis direction is depressed to start the mode.

(4) The image forming apparatus outputs a test image sample as shown in FIG. 13A. As conditions to form the sample, in order to form images of complete solid black copy, halftone, blank copy, and the like the images are obtained under the primary charging conditions to form the above surface potentials, the exposure is performed under three kinds of image exposing conditions (F0, 80, and 00 hex in FIG. 11 in case of the 8-bit signal), development, transfer, and fixing are performed under the above-mentioned developing conditions to output the samples.

(5) The output samples is mounted on the original stage so as to set the leading edge and this side or inner side in the sheet passing direction to specific positions by the mode executor. Whether the mounting is completed is discriminated by original recognizing means (not shown).

(6) When the completion of the mounting is discriminated, the original is read by the reader as mentioned above. For the reading by the reader, it is desired to read at a resolution of about 400 to 600 dpi.

(7) Whether the original is a test image sample or not is discriminated on the basis of the discrimination of whether the density gradation has the same pattern as that of the sample or not.

(8) When it is discriminated that it is the test image sample, the density distribution in the axis direction is calculated as shown in FIG. 13B. When the test image samples are formed at F0, 80, 00 hex of the PWM level, a read density distribution in a halftone portion of 80 hex in which the unevenness can be most detected is calculated (the density distribution can also be calculated at F0, 80, and 00 hex, respectively).

(9) When the target density is set to 0.5 in FIG. 13B, increase and decrease amounts to 0.5 of the read density distribution in the halftone portion are calculated so as to correspond to each pixel in the main scanning direction. When minus correction is shown by a negative sign and plus correction is shown by a positive sign, as shown in FIG. 13C, a graph of necessary correction density obtained by reversing the polarity in FIG. 13B is derived.

(10) A correction light amount (correction level) to each pixel of the laser for dot exposure is obtained from the graph of the necessary correction density by referring to FIG. 14. For example, in the case where the necessary correction density is equal to +0.8 in FIG. 14, it is necessary to correct the surface potential by −200V, light amount on the surface of the photosensitive drum by +0.25 $\mu$J, and the image data by +80 hex. In this manner, the correction amount level corresponding to each pixel in the main scanning direction is allocated to form a correction table. In this instance, the mode is finished and the operation panel as an input interface unit of the image forming apparatus returns to the ordinary copying mode or printing mode.

As mentioned above, since no current leak occurs between the drum and the separation charge shield portion, even if the operating speed of the image forming apparatus is high, the total current amount for separation can be remarkably increased and the applied voltage can be increased, so that the separation performance can be extremely improved.

Particularly, in the case where the apparatus has been used for a long time, the paper particles of the transfer sheet or the scattered toners are deposited on the shield of the separate charger and stain the shield. Even when unevenness as discharge impedance occurs in a low potential shield portion as a discharge counter electrode, the leak does not occur, so that the stable separation performance can be assured in the use for a long time.

Since the leak does not occur in a high humidity environment as well, the stable separation performance can be assured in the use of each environment.

Further in the non-image area for a period of time during which the image is not formed, naturally, the leak does not occur and the preliminary rotating state or the like is easily selected depending on the use conditions, so that the apparatus performance becomes stable.

Additionally, for the failure derived by the leak, such a failure that the pit is formed on the photosensitive drum by the voltage attack at the leak time to generate a black dot or the discharging wire of the separate charger is disconnected can also be prevented.

Next, since a time to flow a large current is extremely reduced, a large amount of ozone product is not adhered on the photosensitive drum and the deterioration in image running does not occur in a high humidity environment. According to the above effects as mentioned above, in the image forming apparatus and digital printing machine such as high-speed network printer to which the printing-out at a high speed is requested, the stable separation performance and transfer sheet conveying performance can be obtained, and a stable high picture quality in which the density unevenness in the longitudinal direction (main scanning direction) does not always exist at high density influenced due to the environment and long use can be obtained.

In the above-mentioned embodiments 1 to 3, the example in which the image is formed by the binarizing process by the error diffusion method or the like (or dither method) has been described. It is a matter of course that it can be applied to the case where the image is formed in accordance with the PWM system. When the image is formed by the PWM system, since the pixel having a different dark/light state (actually, the pixel having a different size due to the area gradation, which is perceived as a dark or light state by observing with the eyes of human being) can be fundamentally formed every pixel, when the density distribution is simply read by the reader unit of the embodiments, the density unevenness of individual pixel can be corrected. However, in order to read out the pixels without deviating only one pixel, it is necessary to read at an extremely high precision. Actually, it is difficult to discriminate the characteristics of each pixel formed on the printer engine side from the read image. When the resolution of the printer is set to 600 dpi, it is necessary to read the image with a deviation less than 1/600 inch, so that it is very difficult in actually. Therefore, as previously described, even when the image is formed by the PWM system, it is desirable to detect the density unevenness in the main scanning direction by using the mean value of a plurality of read pixels continuously arranged in the main scanning direction and to correct it.

Although the present invention has been described with respect to the printer as an example, it can be applied to a system constructed by a plurality of devices (for example, host computer, interface device, reader, and printer).

In this case, since the above processes can be performed in a portion corresponding to the host computer, the present invention can be accomplished in such a manner that a storage medium in which program codes of software to realize the functions of the foregoing embodiments has been recorded is supplied to the system or apparatus and the computer (or CPU or MPU) of the system or apparatus reads out and executes the program codes stored in the storage medium.

In this case, the program codes themselves read out from the storage medium realize the functions of the foregoing embodiments. The storage medium in which the program codes have been stored constructs the present invention.

As a storage medium to supply the program codes, a floppy disk, a hard disk, an optical disk, a magnetooptical disk, a CD-ROM, a CD-R, a magnetic tape, a non-volatile memory card, or an ROM can be used.

Furthermore, needless to say, the present invention covers that the functions of the above-mentioned embodiments are realized by executing the program codes read out by the computer, and in addition, an OS (operating system) or the like operated on the computer executes a part or whole of the actual processing on the basis of the instructions of the program codes, which permits realizing the functions of the above-mentioned embodiments.

Furthermore, needless to say, the present invention covers that the program codes read out from the storage medium is written into a memory provided for a function extension board inserted in the computer or a function extension unit connected to the computer, after that, the CPU or the like provided for the function extension board or function extension unit executes a part or the whole of the actual processing on the basis of the instructions of the program codes, which permits realizing the functions of the foregoing embodiments.

The embodiments of the present invention have been made. The present invention is not limited to the foregoing embodiments but many modifications and variations are possible within the spirit and scope of the appended claims of the invention.

What is claimed is:

1. An image forming apparatus comprising:

an image bearing member for bearing a toner image;

transfer means for transferring the toner image on said image bearing member to a transfer material;

a separate charger for allowing the transfer material to be easily separated from said image bearing member; and voltage applying means for controlling a voltage to be applied to said separate charger, wherein said voltage applying means applies a lower voltage than a voltage in separating when no transfer material exists between said image bearing member and said separate charger.

2. An image forming apparatus according to claim 1, wherein said image bearing member has an amorphous-Si photosensitive member.

3. An image forming apparatus according to claim 1, wherein said voltage applying means applies the lower voltage for a preparation time period before image formation.

4. An image forming apparatus according to claim 1, wherein said voltage applying means applies the lower voltage for a post-process time period after image formation.

5. An image forming apparatus according to claim 1, wherein said voltage applying means applies the lower voltage when an area to bear the toner on said image bearing member faces said separate charger.

6. An image forming apparatus according to claim 1, wherein a voltage to be applied to said separate charger has an AC component and said voltage applying means changes a magnitude of the AC component.

* * * * *